US011208812B2

(12) United States Patent
Bergelin et al.

(10) Patent No.: US 11,208,812 B2
(45) Date of Patent: Dec. 28, 2021

(54) FLOORING SYSTEM PROVIDED WITH A CONNECTING SYSTEM AND AN ASSOCIATED CONNECTING DEVICE

(71) Applicant: Ceraloc Innovation AB, Viken (SE)

(72) Inventors: Marcus Bergelin, Lerberget (SE); Roger Ylikangas, Lerberget (SE); Anders Nilsson, Helsingborg (SE); Karl Quist, Höganäs (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

(21) Appl. No.: 16/437,565

(22) Filed: Jun. 11, 2019

(65) Prior Publication Data

US 2019/0383026 A1 Dec. 19, 2019

(30) Foreign Application Priority Data

Jun. 13, 2018 (SE) ..... 1850723-6

(51) Int. Cl.
*E04F 15/02* (2006.01)

(52) U.S. Cl.
CPC .. *E04F 15/02016* (2013.01); *E04F 15/02022* (2013.01)

(58) Field of Classification Search
CPC ..... E04F 2201/0517; E04F 2201/0523; E04F 2201/0535; E04F 2201/023; E04F 2201/041; E04F 2201/042; E04F 2015/02066; E04F 2015/02072; E04F 2015/02077; E04F 2015/021; E04F 2015/02116; E04F 15/02038; E04F 15/02044; E04F 15/02005; E04F 15/02011; E04F 15/02016; E04F 15/02022

See application file for complete search history.

(56) References Cited

U.S. PATENT DOCUMENTS 87,853 A 3/1869 Kappes
108,068 A 10/1870 Utley
(Continued)

FOREIGN PATENT DOCUMENTS

CN 201588375 U 9/2010
CN 102383575 A 3/2012
(Continued)

OTHER PUBLICATIONS

U.S. Appl. No. 16/822,130, Pervan.
(Continued)

*Primary Examiner* — Jessica L Laux
(74) *Attorney, Agent, or Firm* — Buchanan Ingersoll & Rooney P.C.

(57) ABSTRACT

A flooring system including floor panels and a connecting system for connecting the floor panels is provided. The flooring system includes a first and a second floor panel, and a connecting device that includes a first and a second connecting element. The first connecting element is configured to cooperate with the first and second floor panel for horizontally connecting the first and second floor panel. The second connecting element is configured to cooperate with the first connecting element for vertically connecting the first and the second floor panel. A connecting device for connecting a first and a second floor panel is also provided.

17 Claims, 10 Drawing Sheets

(56) References Cited

U.S. PATENT DOCUMENTS 213,740 A 4/1879 Conner
274,354 A 3/1883 McCarthy et al.
876,693 A 1/1908 Coldwell
1,898,364 A 2/1933 Gynn
2,110,728 A 3/1938 Hoggatt
2,430,200 A 11/1947 Wilson
2,889,016 A 6/1959 Warren
3,099,110 A 7/1963 Spaight
3,147,522 A 9/1964 Schumm
3,187,612 A 6/1965 Hervey
3,731,445 A 5/1973 Hoffmann et al.
3,939,546 A 2/1976 Hernandez
4,169,688 A 10/1979 Toshio
4,426,820 A 1/1984 Terbrack et al.
4,447,172 A 5/1984 Galbreath
4,512,131 A 4/1985 Laramore
4,599,841 A 7/1986 Haid
4,819,932 A 4/1989 Trotter, Jr.
5,135,597 A 8/1992 Barker
5,272,850 A 12/1993 Mysliwiec et al.
5,295,341 A 3/1994 Kajiwara
5,435,610 A 7/1995 Roberts
5,485,702 A 1/1996 Sholton
5,577,357 A 11/1996 Civelli
5,845,548 A 12/1998 Nelson
5,860,267 A 1/1999 Pervan
5,950,389 A 9/1999 Porter
5,970,675 A 10/1999 Schray
6,006,486 A 12/1999 Moriau et al.
6,094,882 A * 8/2000 Pervan ..... E04F 15/04 29/897.3
6,182,410 B1 2/2001 Pervan
6,203,653 B1 3/2001 Seidner
6,205,639 B1 3/2001 Pervan
6,254,301 B1 7/2001 Hatch
6,295,779 B1 10/2001 Canfield
6,332,733 B1 12/2001 Hamberger
6,339,908 B1 1/2002 Chuang
6,358,352 B1 3/2002 Schmidt
6,418,683 B1 7/2002 Martensson et al.
6,449,918 B1 9/2002 Nelson
6,450,235 B1 9/2002 Lee
6,490,836 B1 12/2002 Moriau et al.
6,550,206 B2 4/2003 Lee
6,576,079 B1 6/2003 Kai
6,584,747 B2 7/2003 Kettler et al.
6,591,568 B1 7/2003 Pålsson
6,681,820 B2 1/2004 Olofsson
6,685,391 B1 2/2004 Gideon
6,729,091 B1 5/2004 Martensson
6,763,643 B1 7/2004 Martensson
6,802,166 B1 10/2004 Durnberger
6,851,241 B2 2/2005 Pervan
6,854,235 B2 2/2005 Martensson
6,862,855 B1 * 3/2005 Milum ..... E04B 5/14 52/384
6,880,307 B2 4/2005 Schwitte et al.
7,040,068 B2 5/2006 Moriau et al.
7,051,486 B2 5/2006 Pervan
7,108,031 B1 9/2006 Secrest
7,171,790 B2 2/2007 Mei
7,243,470 B2 7/2007 Chae
7,257,926 B1 8/2007 Kirby et al.
7,637,068 B2 12/2009 Pervan
7,654,055 B2 2/2010 Ricker
7,677,005 B2 3/2010 Pervan
7,716,889 B2 5/2010 Pervan
7,757,452 B2 7/2010 Pervan
7,805,903 B2 10/2010 Liu
7,841,150 B2 11/2010 Pervan
7,908,815 B2 3/2011 Pervan et al.
7,980,039 B2 7/2011 Groeke
8,156,705 B2 4/2012 Alford et al.
8,181,416 B2 5/2012 Pervan et al.
8,234,830 B2 8/2012 Pervan et al.
8,276,343 B2 10/2012 Yang
8,302,367 B2 11/2012 Schulte
8,336,272 B2 12/2012 Prager et al.
8,341,915 B2 1/2013 Pervan et al.
8,429,870 B2 4/2013 Chen et al.
8,448,402 B2 5/2013 Pervan et al.
8,650,826 B2 2/2014 Pervan
8,733,410 B2 5/2014 Pervan
8,763,340 B2 7/2014 Pervan et al.
9,243,411 B2 1/2016 Pervan et al.
9,314,936 B2 4/2016 Pervan
9,657,483 B2 5/2017 Pervan et al.
10,041,258 B2 8/2018 Pervan
10,221,576 B2 3/2019 Pervan et al.
10,626,620 B2 4/2020 Pervan
10,697,187 B2 6/2020 Pervan et al.
2001/0010139 A1 8/2001 De Kerpel
2001/0024707 A1 9/2001 Andersson et al.
2002/0095894 A1 7/2002 Pervan
2003/0037504 A1 2/2003 Schwitte et al.
2003/0084636 A1 5/2003 Pervan
2003/0101674 A1 6/2003 Pervan et al.
2003/0180091 A1 9/2003 Stridsman
2004/0016196 A1 1/2004 Pervan
2004/0139676 A1 7/2004 Knauseder
2004/0144050 A1 7/2004 Kellner
2004/0182033 A1 9/2004 Wernersson
2004/0206036 A1 10/2004 Pervan
2004/0211143 A1 10/2004 Hannig
2004/0244325 A1 12/2004 Nelson
2004/0250492 A1 12/2004 Becker
2005/0028474 A1 2/2005 Kim
2005/0050827 A1 3/2005 Schitter
2005/0102937 A1 5/2005 Pervan
2005/0160694 A1 7/2005 Pervan
2005/0252130 A1 11/2005 Martensson
2006/0070333 A1 4/2006 Pervan
2006/0156670 A1 7/2006 Knauseder
2006/0236642 A1 10/2006 Pervan
2006/0260254 A1 11/2006 Pervan
2007/0028547 A1 2/2007 Grafenauer et al.
2007/0151189 A1 7/2007 Yang et al.
2007/0220822 A1 9/2007 Permesang
2008/0000182 A1 1/2008 Pervan
2008/0028707 A1 2/2008 Pervan
2008/0041008 A1 2/2008 Pervan
2008/0110125 A1 5/2008 Pervan
2008/0134607 A1 6/2008 Pervan et al.
2008/0216434 A1 9/2008 Pervan
2008/0216920 A1 9/2008 Pervan
2009/0019806 A1 1/2009 Muehlebach
2009/0056339 A1 3/2009 Fischer et al.
2009/0107076 A1 4/2009 Kim
2009/0133353 A1 5/2009 Pervan et al.
2009/0151290 A1 6/2009 Liu
2009/0193741 A1 8/2009 Capelle
2009/0193748 A1 8/2009 Boo et al.
2010/0170189 A1 7/2010 Schulte
2010/0173122 A1 7/2010 Susnjara
2010/0300029 A1 12/2010 Braun
2011/0016815 A1 1/2011 Yang
2011/0113713 A1 5/2011 Lui
2011/0131916 A1 6/2011 Chen
2011/0167751 A1 7/2011 Engström
2011/0197535 A1 8/2011 Baker et al.
2011/0271632 A1 11/2011 Cappelle et al.
2012/0096801 A1 4/2012 Cappelle
2012/0192521 A1 8/2012 Schulte
2013/0008117 A1 1/2013 Pervan
2013/0014463 A1 1/2013 Pervan
2013/0019555 A1 1/2013 Pervan
2013/0036695 A1 2/2013 Durnberger
2013/0042562 A1 2/2013 Pervan
2013/0042563 A1 2/2013 Pervan et al.
2013/0042564 A1 2/2013 Pervan et al.
2013/0042565 A1 2/2013 Pervan
2013/0047536 A1 2/2013 Pervan
2013/0055950 A1 3/2013 Pervan
2013/0160390 A1 6/2013 Stockl

(56) References Cited

U.S. PATENT DOCUMENTS

| | | | | |
|---|---|---|---|---|
| 2014/0157700 | A1* | 6/2014 | Martensson | E04F 15/102 52/309.13 |
| 2014/0223852 | A1 | 8/2014 | Pervan | |
| 2014/0287194 | A1 | 9/2014 | Pervan et al. | |
| 2014/0335273 | A1 | 11/2014 | Haller | |
| 2016/0060880 | A1* | 3/2016 | Stover | E04F 15/02044 52/582.2 |
| 2016/0168865 | A1* | 6/2016 | Pervan | B32B 5/14 52/309.1 |
| 2016/0201337 | A1 | 7/2016 | Pervan et al. | |
| 2016/0237695 | A1 | 8/2016 | Pervan | |
| 2016/0356048 | A1* | 12/2016 | Stover | E04F 15/04 |
| 2017/0234020 | A1 | 8/2017 | Pervan et al. | |
| 2018/0179764 | A1 | 6/2018 | Pervan | |
| 2019/0161977 | A1 | 5/2019 | Pervan et al. | |
| 2020/0217083 | A1 | 7/2020 | Pervan | |

FOREIGN PATENT DOCUMENTS

| | | | | |
|---|---|---|---|---|
| DE | 138 992 | C | 7/1901 | |
| DE | 142 293 | C | 7/1902 | |
| DE | 2 159 042 | | 6/1973 | |
| DE | 33 10 281 | A1 | 10/1984 | |
| DE | 33 43 601 | A1 | 6/1985 | |
| DE | 42 15 273 | A1 | 11/1993 | |
| DE | 42 42 530 | A1 | 6/1994 | |
| DE | 196 01 322 | A | 5/1997 | |
| DE | 200 02 744 | U1 | 8/2000 | |
| DE | 10 2006 020 135 | A1 | 11/2007 | |
| EP | 1 120 515 | A1 | 8/2001 | |
| EP | 1 146 182 | A2 | 10/2001 | |
| EP | 1 441 086 | A1 | 7/2004 | |
| EP | 1 640 530 | A2 | 3/2006 | |
| EP | 1 373 658 | B1 | 12/2006 | |
| EP | 2397623 | A1 * | 12/2011 | E04B 5/00 |
| EP | 2 492 416 | A1 | 8/2012 | |
| EP | 2 670 928 | | 12/2013 | |
| EP | 2 670 928 | B1 | 6/2017 | |
| ES | 1070838 | U | 11/2009 | |
| FR | 2 810 060 | A1 | 12/2001 | |
| GB | 2483525 | A * | 3/2012 | E04F 15/02016 |
| JP | H06-146553 | A | 5/1994 | |
| WO | WO 94/26999 | A1 | 11/1994 | |
| WO | WO 96/27721 | A1 | 9/1996 | |
| WO | WO 97/47834 | A1 | 12/1997 | |
| WO | WO 98/21428 | A1 | 5/1998 | |
| WO | WO 99/66151 | A1 | 12/1999 | |
| WO | WO 99/66152 | A1 | 12/1999 | |
| WO | WO 00/20705 | A1 | 4/2000 | |
| WO | WO 00/20706 | A1 | 4/2000 | |
| WO | WO 00/47841 | A1 | 8/2000 | |
| WO | WO 01/75247 | A1 | 10/2001 | |
| WO | WO 02/055809 | A1 | 7/2002 | |
| WO | WO 02/055810 | A1 | 7/2002 | |
| WO | WO 03/083234 | A1 | 10/2003 | |
| WO | WO 2006/043893 | A1 | 4/2006 | |
| WO | WO 2006/104436 | A1 | 10/2006 | |
| WO | WO 2007/015669 | A2 | 2/2007 | |
| WO | WO 2007/142589 | A1 | 12/2007 | |
| WO | WO 2008/004960 | A2 | 1/2008 | |
| WO | WO 2008/004960 | A3 | 1/2008 | |
| WO | WO 2008/004960 | A8 | 1/2008 | |
| WO | WO 2008/017281 | A1 | 2/2008 | |
| WO | WO 2009/075998 | A2 | 6/2009 | |
| WO | WO 2010/087752 | A1 | 8/2010 | |
| WO | WO 2011/127981 | A1 | 10/2011 | |
| WO | WO 2012/045343 | A1 | 4/2012 | |
| WO | WO 2013/041264 | A1 | 3/2013 | |

OTHER PUBLICATIONS

Swedish Search Report issued in SE 1850723-6, dated Jan. 10, 2019, PRV-Swedish patent and Registration Office, Stockholm, SE, 9 pages.

International Search Report and Written Opinion issued in PCT/SE2019/050544, dated Aug. 26, 2019, Patent-och registreringsverket, Stockholm, SE, 12 pages.

Laminate Flooring Tips (http://flooring.lifetips.com/cat/61734/laminate-flooring-tips/index.html). Copyright 2000. 12 pages.

Pervan, Darko (Author), Technical Disclosure entitled "VA070 Strip Part," IP com No. IPCOM000210867D, Sep. 13, 2011, IP.com Prior Art Database, Accession No. An XP013144908; 43 pages.

Pervan, Darko, U.S. Appl. No. 16/822,130 entitled "Mechanical Locking System for floor Panels," filed Mar. 18, 2020.

* cited by examiner

FLOORING SYSTEM PROVIDED WITH A CONNECTING SYSTEM AND AN ASSOCIATED CONNECTING DEVICE

CROSS REFERENCE TO RELATED APPLICATIONS

The present application claims the benefit of Swedish Application No. 1850723-6, filed on Jun. 13, 2018. The entire contents of Swedish Application No. 1850723-6 are hereby incorporated herein by reference in their entirety.

TECHNICAL FIELD

The disclosure generally relates to flooring systems comprising floor panels and a connecting system for connecting the floor panels. More specifically, the flooring system comprises a connecting device for horizontal and vertical connection of a first and a second floor panel, and which comprises a first and a second connecting element. The flooring system is particularly advantageous for floor panels that are installed in a floating manner. The disclosure also relates to the connecting device itself.

BACKGROUND

It is known in the art how to utilize separate locking components, such as clips or strips, in mechanical locking systems for interlocking floor panels. Such mechanical locking systems offer several advantages over integrated mechanical locking systems comprising a tongue and a groove provided in a pair of adjacent floor panels. For example, the profiling of the floor panels may be greatly simplified and the, possibly more complicated, locking geometries may instead be provided in the separate locking components.

Both one-piece and two-piece locking components are known. EP 2 492 416 A1 discloses a system with attachment parts made in one piece and comprising two projecting members which are introduced in recesses of two adjacent covering panels for connecting the covering panels to one another. Moreover, EP 2 670 928 A1 discloses a two-piece connection system comprising a fixing plate and a locking member, wherein the fixing plate has a raised central portion, and wherein the locking member is configured to co-operatively secure the central portion. The system may also comprise panels each comprising a recess configured to accept complementary fixing plate protrusions to help secure the fixing plate to the panels. The connection system is adapted to be securely mounted to a sub-floor.

However, there is still room for improvements, especially for floating panels. Indeed, in some of the known locking systems it is hard to position the locking components with respect to the panels and/or with respect to each other. Moreover, complex maneuvers or actions may be needed when removing or replacing panels.

SUMMARY

It is therefore an object of at least embodiments of the present inventive concept to provide a more adjustable flooring system and connection system for connecting floor panels that are installed in a floating manner.

Another object of at least embodiments of the present inventive concept is to provide a flooring system and a connection system that permit a more reliable connection of the floor panels.

Yet another object of at least embodiments of the present inventive concept is to provide a flooring system and a connection system that allow for a simpler removal or replacement of individual floor panels.

It is also an object of at least embodiments of the present inventive concept to provide a connecting device for flooring systems and connection systems as those described above.

According to a first aspect of the inventive concept, there is provided a flooring system comprising floor panels and a connecting system for connecting the floor panels. The flooring system comprises a first floor panel and a second floor panel, and a connecting device comprising a first connecting element and a second connecting element. The first connecting element is configured to cooperate, preferably engage, with the first floor panel and the second floor panel for horizontally connecting the first floor panel and the second floor panel. The second connecting element is configured to cooperate with the first connecting element for vertically connecting the first floor panel and the second floor panel.

In accordance with certain embodiments of the inventive concept, there is provided a connecting system which allows vertical connection of the panels after the panels have been horizontally connected. In particular, the panels may be provided on a support structure, such as a subfloor, may be horizontally connected to each other in a first stage using the first connecting elements, and may be vertically connected to each other in a second stage using the second connecting elements. This may be a great advantage during installation of the panels since a temporary arrangement of the panels on the support structure may be provided in the first stage and a final connection of the panels may be provided in the second stage. Suitable adjustments of the panels or of the support structure, e.g., levelling of the panels, may be performed before the final connection of the panels. Hence, a more adjustable connecting system, especially for floating installations, is provided.

Each of the first and second floor panels, hereafter often referred only to as "panels", may be horizontally connected to the first connecting element. Moreover, each of the first and second panels may be vertically connected to the connecting device. The connecting system may be a mechanical connecting system, and preferably is separately formed from the panels. For example, the first and/or second connecting elements may be formed as strips or clips.

The connecting device may have a longitudinal extension and a transverse extension extending in a horizontal plane. The longitudinal extension may be arranged along an edge portion of the panels. Preferably, the longitudinal extension is larger than the transversal extension. The connecting device may have a vertical extension which is perpendicular to the horizontal plane.

A horizontal direction of a panel in which the panels may be horizontally connected may be a direction which is perpendicular to a surface normal of a top side of the panel. The horizontal direction may be directed perpendicularly to a vertical plane arranged between the first and second panels, such as inwards and/or outwards from the panel. The vertical plane may have a surface normal which is parallel with the transverse extension of the connecting device in a connected state of the panels.

A vertical direction of a panel in which the panels may be vertically connected may be a direction which is parallel with the surface normal of a panel.

By being horizontally connected, the panels may be connected to each other in the horizontal direction of the first and/or second panel and, preferably, also in a horizontal direction being opposite to the horizontal direction. In a horizontally connected state, at least the first connecting element may be installed in the connecting system, and optionally also the second connecting element.

By being vertically connected, the panels may be connected to each other in the vertical direction of the first and/or second panel and, preferably, also in a vertical direction being opposite to the vertical direction.

The second connecting device may be connected, preferably removably connected, to the first connecting device. The second connecting element may be further configured to cooperate, preferably engage, with the first and/or second panel for vertically connecting the first and second panels. The first connecting device may be connected, such as horizontally and/or vertically connected, to the first panel.

The first connecting element may be configured to only horizontally connect the panels. The second connecting element may be configured to only vertically connect the panels.

The cooperation between the first and second connecting elements may prevent a vertical displacement upwards of the second connecting element with respect to the first connecting element. The first and second connecting elements may be disengaged by applying a separation force exceeding a certain critical force, or by using a tool. Moreover, the cooperation between the first and second connecting elements may prevent a vertical displacement upwards of the first and/or second panels with respect to the connecting device, such as an entirely vertical displacement upwards.

A portion of the connecting device, in particular a visible portion of the second connecting element may be decorative. A flooring system comprising a plurality of connecting devices may comprise a plurality of second connecting elements having different characteristics, such as at least one of a colour, a design, a material, etc. The characteristics may be matched with characteristics of top sides of the panels.

A "connected state" of the panels may be a horizontally and/or a vertically connected state of the panels, preferably both horizontally and vertically connected. In a "connected state" of the connecting device, the first and second connecting elements may be connected, such as vertically connected, to each other. When there is no risk of confusion whether it is the panels or the connecting device that is concerned, the term "connected state" will be used.

By a direction "upwards" and "downwards" is meant a vertical direction away from and towards the support structure, respectively, such as when the panel is provided on the support structure. By "inwards" and "outwards" from a panel is meant a horizontal direction towards a centre of the panel and a direction away from the centre of the panel, respectively.

An edge portion of the panel may comprise at least one of a side edge of the panel, a portion of a top side of the panel, and a portion of an underside of the panel. The edge portion may comprise the side edge, the portion of the top side, and the portion of the underside. The edge portion may extend along a direction which is perpendicular to the horizontal direction as well as to the vertical direction in which the panels are connected. This direction may be parallel with the longitudinal extension of the connecting device in the connected state of the panels.

In some embodiments, there may be a supporting material, such as foam, felt paper, or a compressible material, provided between the first connecting element and the support structure, and preferably provided under the entire first and second panels. In one example, the foam is flexible. In one example, the foam is rigid and/or may be configured to be compressed. In some embodiments, however, the supporting material, preferably a compressible material, is provided under the first connecting element only, and optionally is attached to it.

The panels, preferably a plurality of panels, may form a continuous floor surface together with the connecting device, preferably a plurality of connecting devices. The panels may have the same sizes. Moreover, the panels may have different sizes, such as two, three, or four different panel sizes. In any of these embodiments, the panels may be square or rectangular. A thickness of each panel may be 4-22 mm, preferably 6-16 mm, more preferably 8-14 mm.

According to one embodiment, the first connecting element comprises a first locking element configured to engage with a locking groove provided in an underside of the first floor panel and a second locking element configured to engage with a locking groove provided in an underside of the second floor panel. Thereby, a horizontal connection between the panels may be provided. Preferably, the locking elements and the locking grooves extend vertically.

In some embodiments, there is no vertical connection between the first connecting element and the first and/or second panel. For example, the respective locking groove may be displaced away from the locking element, such as by a vertical displacement only, with small or even no resistance. The vertical connection between the connecting device and the first and/or second panel may be provided when the second connecting element cooperates with the first connecting element.

A vertical position of an uppermost surface of each locking element may in the connected state be essentially equal or lower than a vertical position of a lowermost surface of the second connecting element. Thereby, the second connecting element may be provided above the locking elements of the first connecting element. This may be useful in embodiments where two connecting devices are arranged perpendicularly to each other in a horizontal plane, and wherein the second connecting element of a first connecting device may be provided vertically above the locking elements of the first connecting element of a second connecting device. This arrangement of two connecting devices may occur in corner portions of the panels.

In one embodiment, in the connected state, a vertical distance from an underside of the first connecting element to the lowermost surface of the second connecting element may be essentially equal or larger than a vertical distance from the underside of the first connecting element to the uppermost surface of any or both of the locking elements. In one embodiment, in the connected state, a vertical distance from a top side of the first (second) panel to an upper wall of the first (second) locking groove may be essentially equal or larger than a vertical distance from the top side of the first (second) panel to the lowermost surface of the second connecting element.

According to one embodiment, the locking groove provided in the first floor panel and/or the locking groove provided in the second floor panel is horizontally spaced inwardly from an edge portion, such as a side edge, of the first floor panel and the second floor panel, respectively.

According to one embodiment, a backside surface of the first connecting element is configured to be provided below or flush with an underside of the first and/or the second floor panel when the first and second floor panels are horizontally connected. In some embodiments, however, the backside of the first connecting element may be configured to be provided above the underside of the first and/or second panel.

An outer part of each panel provided outside of each locking groove may have a smaller thickness than a thickness in an inner part provided inwardly of the locking groove. Thereby, a portion of a bottom portion of the first connecting element may be accommodated under the panels. An engagement between the edge portions having a smaller thickness and the bottom portion may provide a vertical connection between the panels and the first connecting element, preventing the panels from being displaced downwards with respect to the connecting device.

The backside surface, which preferably is planar, may be provided in the bottom portion of the first connecting element. In any of the embodiments above, however, the bottom portion may have a varying thickness, such as along the transverse direction. In particular, the backside surface may be non-planar. Thereby, contact forces between regions of the first connecting element and the panels may be adapted.

The bottom portion may comprise at least one base portion. Each base portion may elevate or level the panels with respect to the support structure, which may be irregular. Alternatively, or additionally, the base portion may exert pressure on, such as compress, a supporting material provided between the first connecting element and the support structure as described above. A thickness of the base portions may be larger than a, preferably maximal, vertical extension of each of the locking grooves. Each base portion may extend along a longitudinal direction of the connecting device, preferably along an entire longitudinal length of the connecting device. In a first example, the at least one base portion is integrally formed with the first connecting element. In a second example, the at least one base portion is separately formed from the first connecting element.

Base portions may be arranged under each locking element. There may be a base portion arranged under a projection that may extend vertically from the bottom portion of the first connecting element. Thereby, the contact forces between the locking elements and the locking grooves and/or between the first and second connecting elements may be increased.

In some embodiments, the base portion is made of a supporting material, preferably a foam or a compressible material, which is provided under, preferably attached to, the first connecting element.

According to one embodiment, each floor panel is made of a solid material, such as a ceramic material or a wood material.

According to one embodiment, each floor panel comprises a support member and a surface member which is bonded or otherwise attached to the support member. Thereby, at least parts of the connecting system, such as recesses (defined below) and locking grooves, may be provided in the support member. In a first example, the support member is made of a material that may be processed, e.g., by a rotating tool. In a second example, the support member is formed by moulding, such as injection moulding or extrusion moulding. Also, a strength and a stability of the panels may be provided by the support member, and the surface member may provide other characteristics, such as a visual appearance or a structure. The surface member is preferably bonded to the support member by means of an adhesive, such as glue. In one example, the support member is rigid. In one example, the support member is flexible. A thickness of the support member may be 2-11 mm, preferably 3-8 mm, more preferably 4-7 mm. A thickness of the surface member may be 2-11 mm, preferably 3-8 mm, more preferably 4-7 mm.

An edge portion of the surface member may extend horizontally beyond at least portions of an edge portion of the support member, thereby forming an upper lip.

According to one embodiment, the surface member comprises ceramic, porcelain, natural stone, artificial stone, marble, glass, or a mineral material. In particular, the surface member may be a ceramic layer, a porcelain layer, a natural stone layer, an artificial stone layer, a marble layer, a glass layer, or a mineral material layer. In some embodiments, the surface member is a powder-based board.

The support member may comprise a composite material. In some embodiments, the support member comprises a thermoplastic, such as vinyl or PVC, and, optionally, a filler, such as at least one selected from the group of fibres, for example wood fibres or cellulose fibres, stone material, for example stone powder, and mineral material. For example, the amount of filler in the support member may be 20-85 wt %, such as 40-80 wt %. The thermoplastic support member may further comprise a plasticizer. In some embodiments, the support member comprises a thermoset, and, optionally, a filler, such as fibres, e.g., wood fibres or cellulose fibres.

The support member may be a cement board, such as a fibre cement panel, fibre concrete panel, a gypsum board, or a magnesium board.

In some embodiments, the support member comprises a wood-fibre material. The support member may be an MDF board, an HDF board, a plywood board, a particle board, a fibreboard, or a compact laminate panel.

In some embodiments, the support member is an SPC (stone plastic composite) panel comprising stone powder, such as limestone powder, and a thermoplastic, such as PVC. In some embodiments, the support member is an LVT (Luxury Vinyl Tile). In some embodiments, the support member is a WPC (Wood-plastic composite) panel. The WPC panel may be foamed or rigid.

It is emphasized that any of the embodiments of the support member and surface member above may be combined. In a first example, the fibre cement panel may be combined with the surface member being a layer of ceramic, porcelain, natural stone, artificial stone, marble, glass, or mineral, described above. In a second example, the SPC panel may be combined with the surface member being a layer of ceramic, porcelain, natural stone, artificial stone, marble, glass, or mineral material, described above.

According to one embodiment, an intermediate member is provided between the support member and the surface member. The intermediate member may be bonded to the support member and the surface member, for example by an adhesive, such as glue. For example, the intermediate member may comprise glass fibre, and may be a glass-fibre layer.

According to one embodiment, an edge portion of the first floor panel and/or the second floor panel comprises a recess. The recess may be provided below an upper lip and/or above a lower lip provided in the edge portion. The lower lip may comprise an inclined upper surface. Thereby, the operation of the connecting device may be made more reliable. The inclined upper surface may be planar.

According to one embodiment, the lower lip extends horizontally beyond the upper lip. According to one embodiment, the upper lip extends horizontally beyond the lower lip. According to one embodiment, the lower lip has the same horizontal extension as the upper lip.

In embodiments in which the panels comprise a support member and a surface member, the recesses are preferably provided in the support member only. Thereby, no profiling may be needed in surface member, which may be particularly advantageous for surface members that are difficult to profile. In one example, an upper wall of the recess is a portion of the support member. In another example, the upper wall of the recess is a portion, such as an underside, of the surface member.

According to one embodiment, an expansion portion of the connecting device is configured to be at least partly provided in the recess of the first and/or second floor panel when the first and second connecting elements are cooperating. Thereby, the first floor panel and the second floor panel may be vertically connected. The vertical connection may be created during connection. The expansion portion may be configured to expand the connecting device. Preferably, the expansion portion is configured to expand in the transverse direction of the connecting device.

The expansion portion may be expanded in a connected state of the connecting device. Thereby, the expansion portion does not return to an unconnected, e.g., initial, position of the expansion portion. By means of this embodiment, an improved and more reliable connection between the panels and the connecting device may be provided.

The expansion portion may be further configured to expand during connection of the first and second connecting elements. In a first example, the expansion portion is configured to expand when the second connecting element engages with the first connecting element. In a second example, the expansion portion is configured to expand when the second connecting element is displaced, such as towards the first connecting element.

The expansion portion, such as the second connecting element, may expand by an engagement between the first and second connecting elements, preferably transversely outwards.

The expansion portion may be provided in the second connecting element, such as in a lower portion of the second connecting element.

The expansion portion may be provided as a deformable portion, such as deformable walls, of the connecting device. For example, the expansion portion may be configured to expand when the connecting device is compressed, which may be particularly relevant when the connecting device is integrally formed as described below.

The second connecting element may be configured to be spaced from the lower lip of the first and/or second panel when the first and second panels are vertically connected. Preferably, the second connecting element is configured to be spaced from the lower lip of the first and/or second panel also during connection of the first and second connecting elements. Thereby, the second connecting element may be connected to the first connecting element more easily and in a more reliable manner.

According to one embodiment, the second connecting element is configured to engage with the first and/or second panel, such as with a lower lip of the first and/or second panel, when the first and second panels are vertically connected. The engagement may be provided when the expansion portion is expanded.

According to one embodiment, the first floor panel and/or the second floor panel comprises a holding portion for holding the second connecting element in position, such as in a horizontal and/or a vertical position. The second connecting element may be held in position with respect to the first and/or the second floor panel. For example, the second connecting element may be held in a pretensioned position. In particular, a portion of the second connecting element, such as a female connecting element and/or the expansion portion, may engage with the holding portion. This may be particularly advantageous when the connecting device comprises at least two first connecting elements. Indeed, the second connecting element may be prevented from being vertically displaced downwards between a pair of adjacent first connecting elements, which may be spaced along the longitudinal direction of the connecting devices, and thereby the second connecting element may be provided in a substantially straight manner.

The holding portion may extend along the edge portion of each panel, preferably along their entire lengths. In one embodiment, the holding portion is a portion of the lower lip of the first and/or second panels. The upper surface of the lower lip may be inclined etc. as described above. In one embodiment, the holding portion is an upwardly extending prominence portion which may be provided on the lower lip. The prominence portion may further hold the second connecting element in position, such as in a horizontal position.

Each of the first and second floor panels may comprise a first pair of opposing edge portions and a second pair of opposing edge portions. According to one embodiment, a connecting geometry may be essentially identical along a circumferential edge portion of each of the first floor panel and second floor panel. This may make the profiling of the panels particularly simple.

The circumferential edge portion of each of the first and second floor panels may comprise the first pair of opposing edge portions and the second pair of opposing edge portions. In particular, the circumferential edge portion of a panel may comprise all edge portions along the entire panel. There may be some portions along the circumferential edge portion, such as corner portions, where the connecting geometry is not essentially identical. For example, this may be the case where recesses and/or locking grooves arranged in two perpendicular edge portions overlap each other.

The connecting geometry of the first floor panel may be essentially identical to the connecting geometry of the second floor panel. In another embodiment, the connecting geometries of the first and second panels may be different.

According to one embodiment, in a connected state of the first and second floor panels, the first and the second floor panels are configured to be vertically displaceable relative to each other, between a first vertical position and a second vertical position, while maintaining the vertical connection. For example, the first panel may be vertically displaceable with respect to the second panel. By means of this embodiment, a flooring system may be provided that is resilient in a vertical direction. Thereby, the flooring system may conform to irregular support structures while maintaining the vertical connection. In particular, the flooring system may be vertically resilient irrespective of the material of the panel, such as the support member, which even may be stiff. Another advantage is that the flooring system may become more resistant to high loads. The vertically relative displacement may be implemented by at least one of a deformation of the connecting device, a compression of the connecting device, and a space between the second connecting element and the lower lip of the first and/or second panel. Optionally, and as described above, a supporting material, such as a foam, may be provided between the first connecting element and the support structure.

According to one embodiment, the floor panels are configured to be floating when connected. By being floating, the panels may be displaceable with respect to the support structure. In particular, there is no direct attachment between the panels and the support structure. However, the panels may be interconnected to each other in a horizontal and/or vertical direction. The panels may be interconnected in two perpendicular horizontal directions such that all panels are displaceable as a single unit. Preferably, the connecting device is not connected to the support structure in any of the embodiments of the present disclosure. The single unit may comprise panels that are interconnected coplanarly.

An advantage of having floating panels as compared to panels mounted to the support structure is that tensions between the panels may be reduced. Indeed, the panels may conform to irregularities of the support structure, and may better adapt to environmental fluctuations, such as moisture and temperature variations. Another advantage is that the panels may be installed at an arbitrary location on the support structure, such as in a centre portion thereof. Moreover, the panels as a single unit may be displaced on the support structure when needed.

According to one embodiment, the first connecting element and the second connecting element are configured to be connected to each other by snapping.

According to one embodiment, the connecting device comprises a male connecting element and a female connecting element, the male connecting element being configured to engage with the female connecting element for providing said vertical connection. The female connecting element may be configured to at least partially enclose the male connecting element in the connected state. Moreover, the male and/or the female connecting element may be resilient.

In one embodiment, the male connecting element may be provided in the first connecting element and the female connecting element is provided in the second connecting element.

In another embodiment, the male connecting element is provided in the second connecting element and the female connecting element is provided in the first connecting element.

The male connecting element may comprise a tip element and the female connecting element may comprise a cavity. The tip element may be provided in, e.g., pressed into, the cavity for obtaining a connected state of the first and second connecting elements. At least one of the tip element and the cavity may be flexible and/or compressible for providing the tip element in the cavity.

The tip element may be provided at an elongated portion, preferably at an end portion thereof. In a first example, the first connecting element comprises the elongated portion in the form of a projection and the second connecting element comprises the cavity. In a second example, a projection comprises the cavity and the second connecting element comprises the elongated portion. In a third example, a projection comprises the elongated portion and the second connecting element comprises the cavity. In any of the first, second, and third examples, the projection may extend vertically from a bottom portion of the first connecting element. In a fourth example, a projection, which may be provided on the second connecting element, comprises the elongated portion and the first connecting element comprises the cavity.

The male connecting element, e.g., its tip element, may comprise a lug element and the female connecting element, such as its cavity, may comprise a flange element. The lug element may comprise at least one lug, such as two, three or four lugs, and the flange element may comprise at least one flange, such as two, three or four flanges. The lug element may engage with the flange element in the connected state of the first and second connecting elements. The lug element may be provided at an outer portion of the tip element and the flange element may be provided at an inner portion of the cavity, such as at an inner portion of a respective protrusion, e.g., provided on either side of the cavity. The engagement between the lug element and the flange element may prevent vertical displacement of the second connecting element at least in a direction away from the first connecting element. The first and second connecting elements may be disengaged by applying a separation force exceeding a certain critical force. Alternatively, the disengagement may be accomplished by a tool, e.g., by inserting a tool into the cavity, e.g., for separating the protrusions.

In some embodiments, the female connecting element, preferably provided in the second connecting element, comprises the expansion portion. For example, the expansion portion may comprise at least one protrusion.

The expansion portion may be configured to expand during connection of the first and second connecting elements by an engagement between the male and the female connecting elements causing an expansion of the expansion portion, such as the second connecting element, preferably transversely outwards.

In the disconnected state, a transverse width of a contact portion of the male connecting element configured to engage with a contact portion of the female connecting element in the connected state of the connecting device may be larger than a transverse width of said contact portion of the female connecting element. Thereby, in the connected state, when the contact portions engage, the female connecting element may not return to its disconnected state; in other words the expansion portion is expanded in the transverse direction. The contact portion of the female connecting element may be displaceable along the transverse direction. The contact portion of the male connecting element may be fixed, such as not being displaceable, along the transverse direction.

According to one embodiment, the first connecting element and the second connecting element are separately formed. In a first example, the first and the second connecting elements comprise the same material. In a second example, the first and the second connecting elements comprise different materials.

According to one embodiment, the first connecting element and the second connecting element are integrally formed. For example, the connecting device may be formed by extrusion or coextrusion. The connecting device may be configured to be compressed from a disconnected state to a connected state.

Generally, the second connecting element may comprise a first part comprising a first material and a second part comprising a second material. The first and second parts may be joined to each other, such as by coextrusion, heating, welding, or by an adhesive. The first and second materials may have different characteristics. For instance, the second material may be stiffer than the first material, the first material preferably being provided in an upper portion of the second connecting element and/or being visible in the connected state of the panels.

The first connecting element and/or the second connecting element may at least partially, preferably completely, be formed of an elastomer, a rubber, a thermoplastic, or a thermoset, such as polyvinyl chloride (PVC), polypropylene (PP), polyethylene (PE), polyamide (PA), polyurethane (PU), Acrylonitrile Butadiene Styrene (ABS), silicone, thermoplastic elastomer (TPE), or polyoxymethylene (POM). Optionally, the first and/or the second connecting element may comprise a filler, e.g., for increasing the rigidity.

Moreover, the first connecting element and/or the second connecting element may be extruded, coextruded, 3D printed or injection moulded. A coextruded second connecting element may comprise a first part comprising a first material and a second part comprising a second material. The first and second material may have different characteristics. For instance, the first material may be more flexible than the second material. For example, the first material may be an elastomer or TPE, and the second material may be PVC.

According to one embodiment, the second connecting element comprises a curable material, such as a grouting material, for example a cement-based grouting material, or a flexible curable material, such as an elastomer. Thereby, a seal, such as a water-proof seal, may be provided between the panels while connecting the panels to the first connecting element. The grouting material may be rigid. Generally, the elastomer may be a thermoset or a thermoplastic. The flexible curable material may be an MS polymer, latex, silicon-based material, such as silicone, epoxy, PU, urethane or an acrylic-silicone resin, etc.

The second connecting element may be made of any of the curable materials above. Moreover, the curable material may be removably arranged on the first connecting element.

According to one embodiment, the first and/or the second connecting element comprises or is made of a metal, such as aluminium.

According to one embodiment, the connecting device is symmetrical around a vertical centre line as seen from a cross-sectional side view of the connecting device. For example, the first connecting element as well as the second connecting element may be symmetric. Moreover, the recess of each of the first and second panels may be provided symmetrically around the vertical centre line, such as in the connected state.

According to one embodiment, the connecting device is asymmetrical around a vertical centre line as seen from a cross-sectional side view of the connecting device. For example, the first connecting element may be symmetric and the second connecting element may be asymmetric. Moreover, the recess of each of the first and second panels may be provided asymmetrically around the vertical centre line. In particular, the recess of the first panel may be vertically offset from the recess of the second panel.

According to one embodiment, an upper portion of the second connecting element is configured to engage with a top portion, such as a surface member, of each of the first and second floor panels, when the first and second panels are vertically connected. The upper portion may be flexible. In particular, it may be more flexible than a lower portion of the second connecting element.

According to one embodiment, a top portion, such as a surface member, of each of the first and the second floor panels comprises a chamfer portion, and/or the second connecting element comprises bevel portion. The chamfer portion may comprise a first chamfer and a second chamfer. The bevel portion may comprise a first bevel and a second bevel. The bevels may be provided on opposite transverse sides of the second connecting element. A shape of the bevels may correspond to a shape of the chamfers. The bevel portion may engage with the chamfer portion when the panels are vertically connected. Thereby, a part of the top sides of the panels may be sealed or concealed and/or a vertical connection between the connecting device and the panels may be provided. In particular, the second connecting element may be prevented from being displaced downwards with respect to the panels. Any of the chamfers or the bevels above may be replaced by a rounded portion.

The top portion of a panel may be an edge portion of the panel, comprising a portion of a side edge and/or a portion of a top side of the panel.

Alternatively, or additionally, the vertical connection of the panels may be provided by an engagement between the bevel portion and chamfer portion, which may prevent displacement of the panels upwards with respect to the connecting device.

The bevel portion may be provided in the second connecting element. In one example, the bevel portion is integrally formed with the second connecting element. In another example, the bevel portion is separately formed from the second connecting element and may be arranged in, such as attached to, an attaching portion of the second connecting element. The separate bevel portion may be more flexible than the attaching portion. Moreover, the separate bevel portion may be replaceable by another bevel portion.

Generally, the second connecting element may provide a seal between the first and second panels. According to one embodiment, the second connecting element is arranged with pretension, such as horizontal pretension, between the first and second floor panels. Thereby, an improved seal between the panels may be provided. Also, an improved horizontal connection may be provided, since the pretensioned second connecting element may push the panels away from each other.

The first and/or the second connecting element may extend at least partly along edge portions of the first and second panels in the connected state. According to one embodiment, the connecting device, preferably each of the first and the second connecting elements, is configured to extend along an entire edge portion of the first and second panels when the first and second panels are horizontally and vertically connected.

The connecting device may connect a pair of panels comprising the first and second panels. It is also part of this disclosure, however, that one connecting device may connect at least two pairs of panels. In one embodiment, the connecting device, preferably the first and the second connecting elements, extends along an edge portion of a first pair of panels, such as the first and second panels, and along an edge portion of a second pair of panels, such as a third and a fourth panel. The third and fourth panels may be connected in the same manner as the first and second panels.

A longitudinal extension of the first and second connecting elements may be essentially the same. According to one embodiment, however, a longitudinal extension of the second connecting element is larger than a longitudinal extension of the first connecting element.

The first connecting element may be configured to extend along a portion of the edge portion of the first and second panels, and the second connecting element may be configured to extend along a larger edge portion, such as an entire edge portion, of the first and second panels when the first and second panels are connected.

The connecting system may comprise a plurality of connecting devices. In one example, the plurality of connecting devices extends along a single pair of edge portions of a first and a second panel. In one example, the plurality of connecting devices extends along pairs of edge portions of several panels.

The connecting device may comprise a single second connecting element and at least two, in particular a plurality, of first connecting elements configured to cooperate with the second connecting element for providing the vertical connection. The first connecting element may be discontinuous and the second connecting element may be continuous along the edge portions of the panels.

In an embodiment in which the connecting device comprises an expansion portion as described above, the expansion portion may be configured to expand intermediate expansion portions of the second connecting element in the transverse direction. The intermediate expansion portions may in the connected state be located between the at least two first connecting elements, or may be adjacent to one first connecting element out of the at least two first connecting elements, along a longitudinal direction of the connecting device. Thereby, an improved connection, in particular vertical connection, between the panels may be provided.

According to one embodiment, the second connecting element, such as a lower portion of the second connecting element, is configured to be spaced from each of the first and second floor panels, such as each support member of the first and second floor panels, when the first and second panels are vertically connected. The lower portion of the second connecting element may be spaced from an inner wall of the recess of the first and/or second panel.

According to one embodiment, the connecting device, preferably the second connecting element, is configured to be operable in a connected state of the first and second floor panels for vertically disconnecting the first and second floor panel. Thereby, the cooperation between the second connecting element and the first connecting element may be removed, e.g., by hand or by a tool. The second connecting element may be disconnected or disengaged from the first connecting element. Moreover, by means of this embodiment, a connecting system is provided whereby an arbitrary panel in a set of connected panels may be removed and replaced. Indeed, a panel may be replaced by disconnecting the panel from adjacent panels by removing one or several second connecting elements, removing the panel, providing a new panel, and connecting it to the adjacent panels by means of the same second connecting element previously used, or by a new second connecting element. Before connecting the new panel, the panels and/or the support structure may have to be reinforced or adjusted for providing a sufficiently stable support and leveled floor surface. The reinforcement and adjustment may be performed without affecting other panels in the set, such as in an adjacent area.

According to one embodiment, the connecting device and the first and/or second floor panel are configured such that, in a vertically disconnected state of the first or the second panel, the first and/or the second floor panel is removable from the connecting device, preferably by a vertical displacement of the first and/or the second floor panel. Thereby, the removal or replacement of panels may be made easier. Also, the panels may be left intact during removal and/or rearrangement of the panels and the risk of damaging them is reduced. Preferably, the first connecting element does not need to be replaced or even removed. Additionally, or alternatively, there may also be an angular displacement of the first or the second floor panel. Preferably, however, the first and/or the second floor panel is removable from the connecting device by a vertical displacement of the first or the second floor panel only, without any angling of the panel. This may be particularly advantageous near obstructions located in the vicinity of the support structure, where the possibility of displacing the panel might be limited. Clearly, the panels preferably also may be provided on the connecting device, such as on the first connecting element, by a vertical displacement of the panels only, without any angling of the panel. The second connecting element may be removed, such as disconnected from the first connecting element, in the vertically disconnected state.

It is noted that an expansion portion may provide a secure vertical connection while providing a simplified removal of the panels, such as by displacing the panels vertically upwards, such as vertically upwards only. Indeed, these characteristics may be accomplished by an expanded and an unexpanded expansion portion, respectively.

There may be a gap between an inner wall of the locking groove of the first panel and an outer wall of the first locking element and/or a gap between an inner wall of the locking groove of the second panel and an outer wall of the second locking element. Preferably, there is a gap between the lower lip of the first panel and a projection of the first connecting element and/or a gap between the lower lip of the second panel and the projection.

According to a second aspect of the inventive concept, there is provided a connecting device for connecting a first floor panel and a second floor panel. The connecting device comprises: a first connecting element and a second connecting element. The first connecting element is configured to cooperate with the first floor panel and the second floor panel for horizontally connecting the first floor panel to the second floor panel. Moreover, the second connecting element is configured to cooperate with the first connecting element for vertically connecting the first floor panel and the second floor panel to the connecting device.

Embodiments of the second aspect are largely analogous to those of the first aspect, wherein reference is made to the above.

Other aspects of the inventive concept and embodiments of the first and second aspects are provided in an embodiment section below. It is emphasized that the embodiments of the first aspect may be combined with embodiments of those aspects as well as with embodiments of the second aspect, and vice versa.

BRIEF DESCRIPTION OF THE DRAWINGS

The disclosure will in the following be described in connection to exemplary embodiments and in greater detail with reference to the appended exemplary drawings, wherein.

DETAILED DESCRIPTION

Figure 1A:
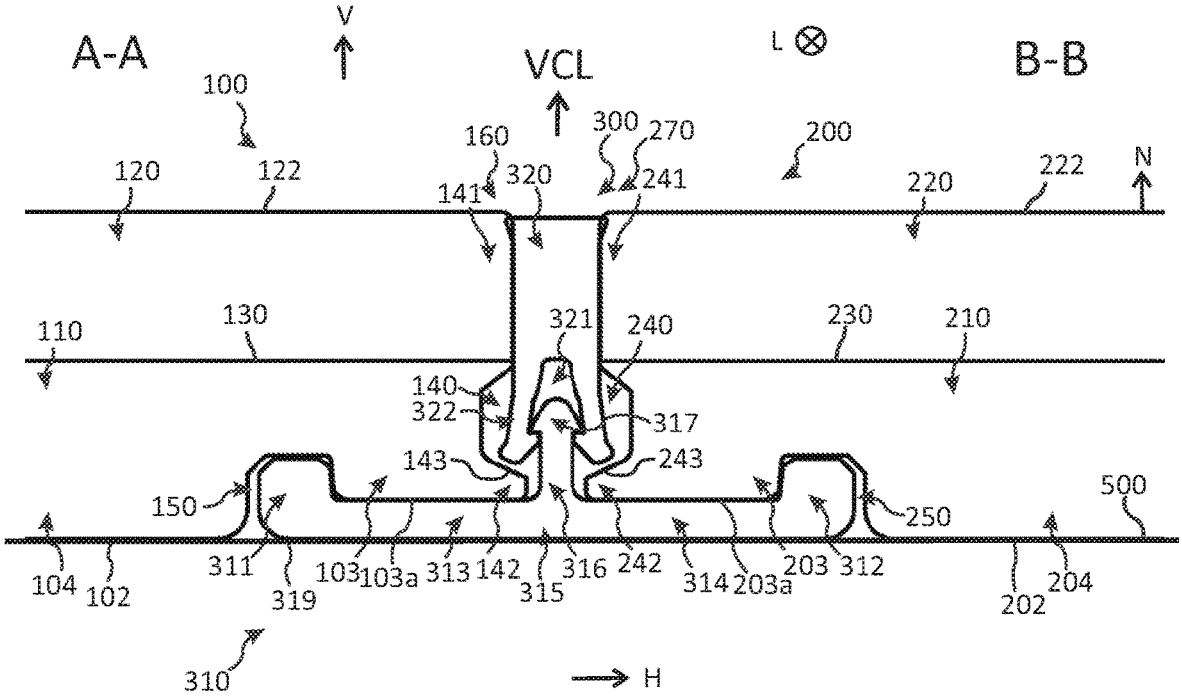
FIGS. 1*a*-1*c* illustrate an embodiment of connected panels in a side view and an embodiment of a connecting device in perspective views.

Next, embodiments of a flooring system comprising a first floor panel 100, a second floor panel 200, and a connecting system for connecting the floor panels will be described with reference to FIGS. 1*a*-1*c*, 2*a*-2*j*, 3*a*-3*h*, 4*a*-4*f*, 5*a*-5*b*, 6*a*-6*d*, and 7*a*-7*d*. As shown in FIGS. 1*a* and 2*a*, the panels are provided on a support structure 500, such as a subfloor, which is often suppressed for clarity.

FIG. 1*a* is a side view of an edge region of connected panels 100, 200. Each panel comprises a support member 110, 210 and a surface member 120, 220 bonded to the support member. Optionally, an intermediate member 130, 230 may be provided between the support member and the surface member. The intermediate member may be provided as an intermediate layer, such as a glass-fibre layer. In one example, the surface member is a ceramic layer and the support member is a fibre cement panel. In one example, the surface member is a ceramic layer and the support member is an SPC panel. Clearly, however, other combinations are part of this disclosure.

An edge portion 160, 270 of each panel comprises a recess 140, 240. The recess is provided between an upper lip 141, 241 and a lower lip 142, 242 provided in the edge portion. The recess may be provided entirely in the support member as may be seen e.g., in FIGS. 1*a*, 2*a*-2*j*, 3*e*-3*f*, 4*c*-4*d*, 5*a*-5*b*, 6*a*-6*d*, 7*a*-7*b* and 7*d*. Moreover, each recess may comprise a lower 140*a*, 240*a*, an upper 140*b*, 240*b* and an inner 140*c*, 240*c* wall. Each lower lip may comprise an upper surface 143, 243 which may be inclined as shown in FIG. 1*a*.

An underside 102, 202 of each panel comprises a locking groove 150, 250. Each locking groove is horizontally spaced inwardly from a side edge 123, 223 of the first and second panel, respectively. Preferably, each locking groove is spaced horizontally inwardly from a horizontally innermost portion of each respective recess 140, 240, such as the inner wall 140*c*, 240*c*. Moreover, each locking groove comprises an inner 150*a*, 250*a*, an outer 150*b*, 250*b*, and an upper 150*c*, 250*c* wall.

The connecting system may comprise a connecting device 300 as well as one or more from the group consisting of the recesses 140, 240, the upper lips 141, 241, the lower lips 142, 242, and the locking grooves 150, 250.

Figure 1B:
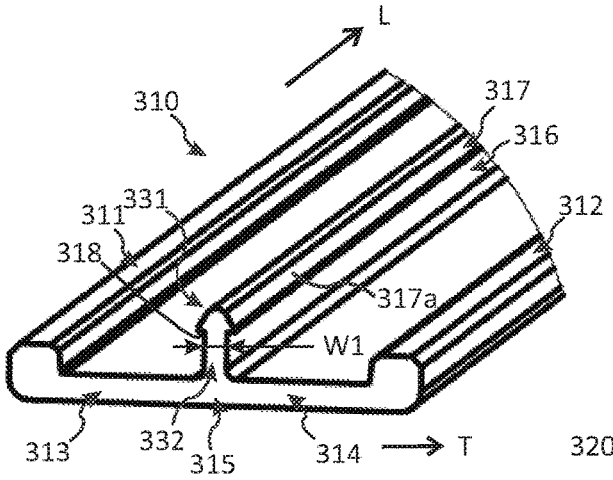
Figure 1C:
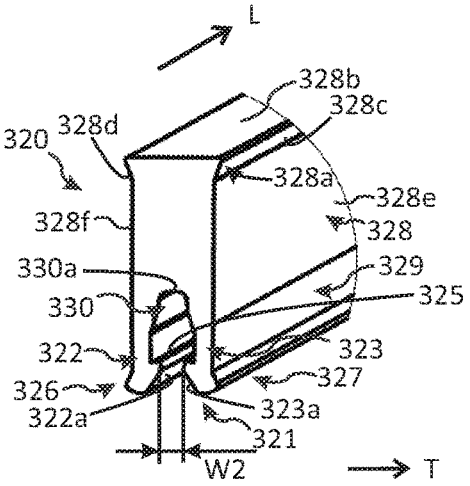
Figure 2A:
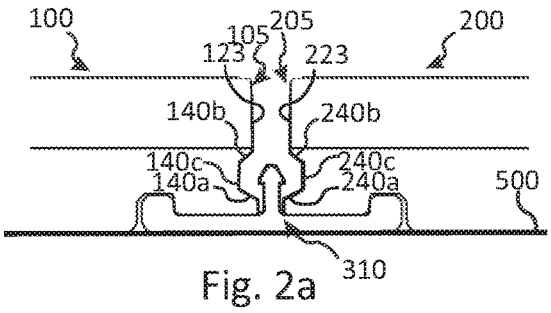
FIGS. 2*a*-2*j* illustrate cross-sectional side views of embodiments of connected panels as well as methods of connecting the panels.

In accordance with the embodiment shown in the perspective views in FIGS. 1*b*-1*c*, the connecting device 300 comprises a first 310 and a second 320 connecting element, each extending along a longitudinal direction L of the connecting device. In some embodiments, the first and second connecting elements comprise an elastomer, a rubber, a thermoplastic or a thermoset. The first connecting element is configured to cooperate with the first 100 and second 200 panels for connecting them in a horizontal direction H, which is perpendicular to a surface normal N of a top side 122, 222 of each panel and perpendicular to a vertical plane VP arranged between the first and second panels. The horizontal direction H is preferably parallel with a transverse direction T of the connecting device in the connected state of the panels. The vertical plane VP has a surface normal M which is parallel with the horizontal direction H. Moreover, the second connecting element is configured to cooperate with the first connecting element for connecting the panels in a vertical direction V, which is parallel with the surface normal N.

The first connecting element 310 comprises a first 311 and a second 312 locking element that are provided at end portions of a respective first 313 and second 314 arm portion which are provided in a bottom portion 315 of the first connecting element. The first 311 and second 312 locking elements extend vertically from the arm portions 313, 314 and are configured to engage with the locking grooves 150 and 250, respectively.

Moreover, the first 310 and second 320 connecting elements comprise a male 317 and a female 321 connecting element, respectively, each extending along the longitudinal direction L of the connecting device, preferably along its entire length. The male connecting element 317 comprises a tip element 331 which is provided at an end portion of an elongated portion 332 in the form of a projection 316. The projection is provided on the first connecting element between the first 311 and second 312 locking elements and extends vertically from the bottom portion 315. The female connecting element comprises a cavity 330 and a first 322 and a second 323 protrusion that are separated by the cavity. The protrusions may be flexible.

The male connecting element 317 is configured to engage with the female connecting element 321, e.g., by snapping, for connecting the first and second connecting elements and for providing the vertical connection of the panels. The tip element 331 may be provided in, e.g., pressed into, the cavity 330 for obtaining the connected state of the first 310 and second 320 connecting elements.

An outer part 103, 203 of each panel provided outside of each locking groove 150, 250 has a smaller thickness than a thickness in an inner part 104, 204 provided inwardly of the locking groove 150, 250. Thereby, a portion of a bottom portion 315 of the first connecting element may be accommodated under the panels. Preferably, an upper surface of each of the arm portions 313, 314 is parallel with the underside 102, 202 of the respective outer part 103, 203. Each outer part 103, 203 may be an undercut. The locking grooves 150, 250 and/or an underside 103*a*, 203*a* of the outer parts 103, 203 may prevent a downward vertical displacement of the panels 100, 200 with respect to the first connecting element 310.

The embodiments of the connecting devices 300 in FIGS. 1*a*-1*c*, 2*a*-2*j*, 3*a*-3*h*, 4*a*-4*f*, and 5*a*-5*b* are symmetrical, or essentially symmetrical, around a vertical centre line VCL as seen from a cross-sectional side view of the connecting device.

An upper portion 328 of the second connecting element is configured to engage with each surface member of the first and second panels in the connected state.

As shown in the perspective views in FIGS. 1*b*-1*c*, the tip element 331 may comprise a lug element 318 and the cavity 330 may comprise a flange element 325. In the present non-limiting embodiment, the lug element comprises two lugs and the flange element comprises two flanges. The lug element engages with the flange element in the connected state of the first and second connecting elements. The lug element 318 is provided at an outer portion of the tip element 331 and the flange element 325 is provided at an inner portion of each protrusion 322, 323.

A transversal width of the upper portion 328 of the second connecting element may increase towards a top surface 328*b* of the second connecting element. The upper portion 328 may comprise a bevel portion 328*a*. The bevel portion 328*a* may comprise a first 328*c* and a second 328*d* bevel. The first 328*c* and second 328*d* bevels may join the top surface 328*b* and optionally may join a first 328*e* and a second 328*f* side wall of the upper portion 328, respectively. The first 328*c* and second 328*f* side walls may be opposite to each other. The bevels 328*c-d* may be inclined or rounded, e.g., curved outwards. The bevels 328*c-d* may engage with a respective top portion 105, 205 of the panels in the connected state. Thereby, a vertical displacement of the second connecting element towards the first connecting element may be prevented in the connected state of the panels. Also, an improved seal may be provided.

As illustrated in the embodiment in FIGS. 1*a*-1*c*, the female connecting element 321 may comprise at least one sliding surface 322*a*, 323*a*, such as an inner sliding surface provided on each of the protrusions 322, 323. Each sliding surface may be inclined or curved. Each sliding surface may be configured to engage with the male connecting element 317 during connection, such as with a corresponding top portion surface 317*a* of the male connecting element. The top portion surface 317*a* may have a shape corresponding to the sliding surfaces 322*a*, 323*a* and may be inclined or curved, as shown e.g., in the embodiment in FIG. 2*b*.

FIGS. 2*a*-2*j* illustrate in cross-sectional side views embodiments of connected panels as well as how to horizontally and vertically connect panels by means of the connecting device.

Figure 2B:
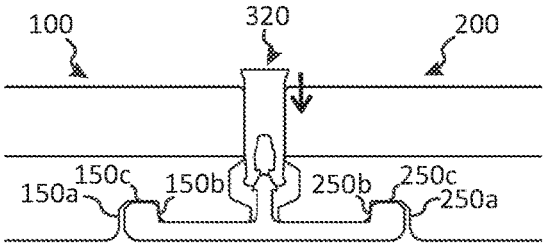
Figure 2C:
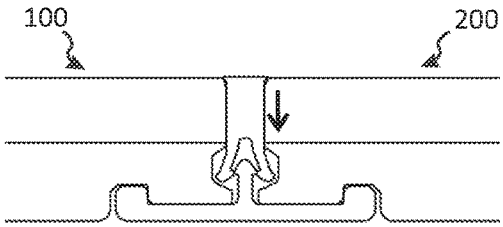

In FIG. 2*a*, two panels 100, 200 are provided on a support structure 500, such as a subfloor, and are horizontally connected to each other by the first connecting element 310. The locking elements 311, 312 have been provided in the locking grooves 150, 250 by means of a vertical, and optionally angling, displacement of the panels relative to the first connecting element. Preferably, the panels are displaced with a vertical displacement only. FIGS. 2*b*-2*c* illustrate how the second connecting element 320 is inserted between the top portions 105, 205 of the panels and becomes connected to the first connecting element, such as by means of a snapping engagement. Thereby, a vertical connection of the panels is obtained as shown in FIGS. 2*d*-2*e*.

Figure 2D:
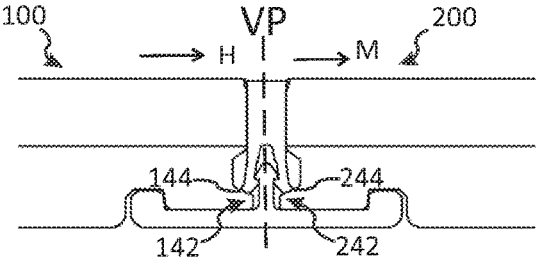

FIG. 2*d* shows an embodiment in which the second connecting element 320 engages with the lower lips 142, 242 of the first and second panels. FIG. 2*e* shows an embodiment in which the second connecting element 320 is spaced from the lower lips 142, 242 by a space S.

Figure 2E:
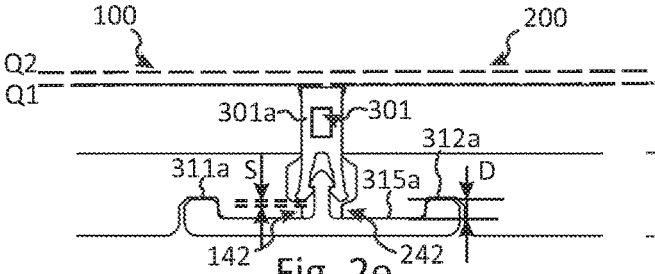
Figure 2F:
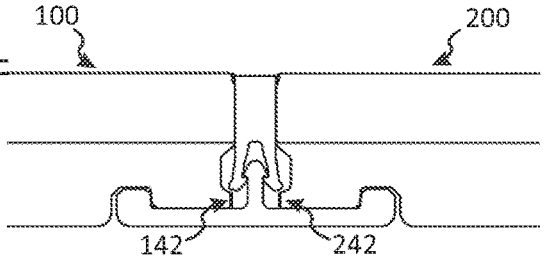

FIG. 2*e* also illustrates that in a reference frame of the first connecting element 310, and optionally also of the second connecting element 320, the first and second panels may be vertically displaceable relative to each other, between a first Q1 and a second Q2 vertical position, while maintaining the vertical connection of the panels. The vertically relative displacement may be implemented by at least one of a deformation or a compression of the connecting device 300, and/or the space S. The distance Q2-Q1 preferably is smaller than a height D of each locking element 311, 312 measured from a top surface 311*a*, 312*a* of the locking element to a surface 315*a* of the bottom portion 315, which preferably engages with a respective underside 103*a*, 203*a* of the outer parts 103, 203 in the connected state.

In the embodiments in FIGS. 1*a* and 2*d*-2*j*, the second connecting element 320, such as a lower portion 329 thereof, is spaced from each of the first and second panels, such as the support members 110, 210. In particular, the lower portion 329 may be spaced from the walls 140*b-c* and 240*b-c*, and optionally also the walls 140*a*, 240*a*.

Figure 2G:
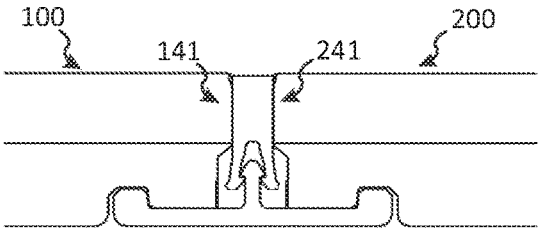
Figure 2H:
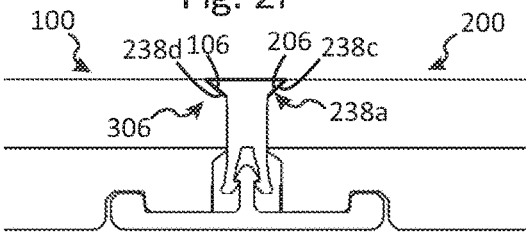
Figure 2I:
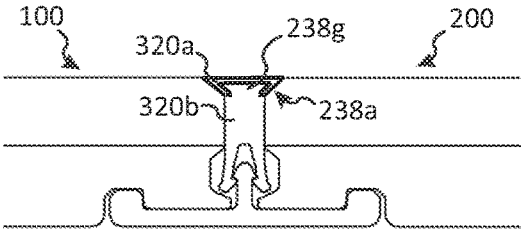

In the embodiments in FIGS. 1*a*, 2*a*-2*d*, 3*a*-3*b*, 3*e*-3*f*, 5*a*, 6*a*-6*d*, 7*a*-7*b* and 7*d*, each lower lip 142, 242 extends horizontally beyond the respective upper lip 141, 241. However, it is also part of this disclosure that the lower lip may have the same horizontal extension as the upper lip as shown in the embodiments in FIGS. 2*e* and 4*c-d* or that the upper lip may extend horizontally beyond the lower lip shown as shown in the embodiment in FIG. 2*f*. In some embodiments, as shown in FIGS. 2*g*-2*h* and FIG. 5*b*, there may be upper lips 141, 241 only, and no lower lips. In some embodiments, as shown in FIGS. 3*a*-3*b* and 7*c*, there may be lower lips 142, 242 only, and no upper lips. In any of the embodiments, each top portion 105, 205, such as the surface member 110, 210, may comprise a chamfer portion 306 comprising a first 106 and a second 206 chamfer. As shown in the embodiments in FIGS. 1*a* and 2*b*-2*j*, the second connecting element may comprise a bevel portion 328*a* comprising a first 328*c* and a second 328*d* bevel. In FIGS. 1*a*, 2*b*-2*g* and 2*j*, the bevels 328*c-d* may engage with a chamfer 106, 206 or rounded portion of the top portions. In FIGS. 2*h*-2*i*, the bevels 328*c-d* engages with a respective chamfer 106, 206.

In the embodiment in FIG. 2*h*, the bevel portion 328*a* is integrally formed with the second connecting element. In the embodiment in FIG. 2*i*, the bevel portion 328*a* may be separately formed from the second connecting element and may be attached to an attaching portion 328*g* of the second connecting element. Alternatively, the second connecting element in the embodiment in FIG. 2*i* may comprise a first part 320*a* comprising a first material and a second part 320*b* comprising a second material which is joined to the first part.

Figure 2J:
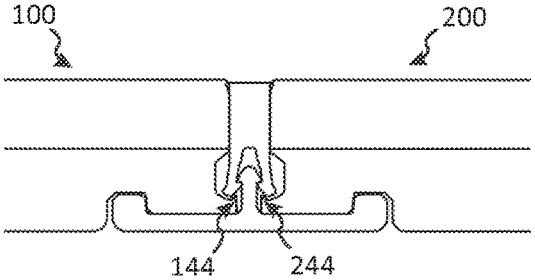
Figure 3A:
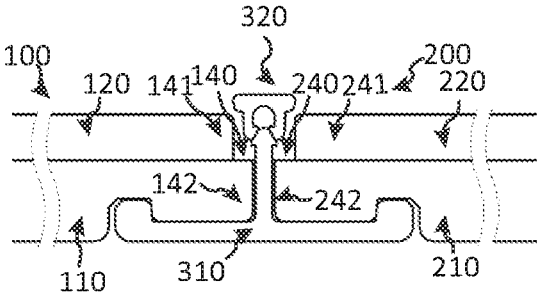
FIGS. 3*a*-3*h* illustrate embodiments of connecting devices and connected panels in perspective views and cross-sectional side views.
Figure 3B:
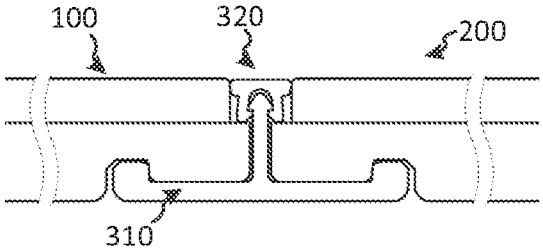

The embodiment in FIG. 2*j* illustrates a first and a second panel comprising a holding portion 144, 244 for holding the second connecting element 320 in position, such as in a horizontal and/or a vertical position. The second connecting element may be held in position with respect to the first and/or the second floor panel. For example, the second connecting element may be held in a pretensioned position. The holding portion may be an upwardly extending prominence portion provided on each of the lower lips 142, 242. FIG. 2*d* illustrates an embodiment wherein the holding portion 144, 244 is formed as a portion of each of the lower lips 142, 242, such as the upper surfaces 140*a*, 240*a*. The upper surface of the lower lips may be inclined.

The embodiments in FIGS. 3*a*-3*b* and 5*b* illustrate that the lower lips 142, 242 or upper lips 141, 241 may be formed by arranging each surface member 120, 220 horizontally offset with respect to the respective support member 110, 120. In FIGS. 3*a*-3*b* the surface member is provided inwardly of the support member. Thereby, the support member may extend beyond the surface member. In FIG. 5*b* the support member is provided inwardly of the surface member. Thereby, the surface member may extend beyond the support member. In any of these embodiments, a side edge 123, 223 of the panels may have a simple form, such as being planar, for example being provided vertically.

In some embodiments, and as shown in FIGS. 1*a*, 2*a*-2*j*, 3*e*-3*f*, 6*a*-6*d*, and 7*a*-7*d*, the upwardly extending projection 316 may be provided below the surface member in the connected state. In some embodiments, and as shown in FIGS. 3*a*-3*b* and 4*c*-4*d*, the upwardly extending projection 316 may be provided above the support member in the connected state.

As shown in the embodiment in FIGS. 1*a*-1*c*, and illustrated during connection in, e.g., the embodiments in FIGS. 2*b*-2*e*, the second connecting element 320 may comprise an expansion portion 326, 327 which is configured to be at least partly provided in the recesses 140, 240 in the vertically connected state. The expansion portion is configured to expand outwards in the transverse direction T of the connecting device during connection of the first and second connecting elements. In the embodiment in FIG. 1*c*, the female connecting element 321 comprises the expansion portion 326, 327. The female connecting element may assume a disconnected position and a connected position in a connected and a disconnected state of the connecting device, respectively. In the connected position, the expansion portion may be expanded. The first 322 and/or the second 323 protrusions may be more horizontally separated along the direction H, preferably being parallel with the transverse direction T, than in the disconnected position. For example, in the disconnected state, a transverse width W1 of the elongated portion 332, such as below the tip element 331, may be larger than a transverse width W2 between the innermost portions 322*b*, 323*b* of the protrusions. Thereby, in the connected state, the protrusions 322, 323 do not return to their initial positions.

Optionally, a portion of the expansion portions 326, 327 may engage with a respective upper wall 140*b*, 240*b* of the recess in the vertically connected state.

Figure 3C:
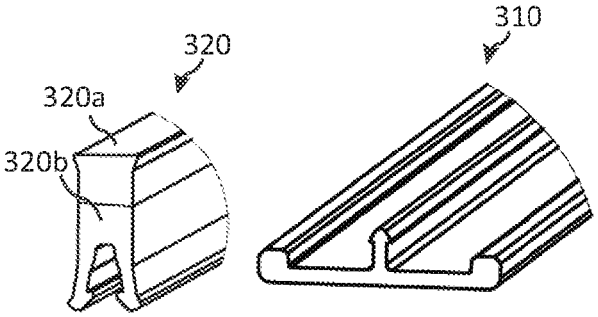
Figure 3D:
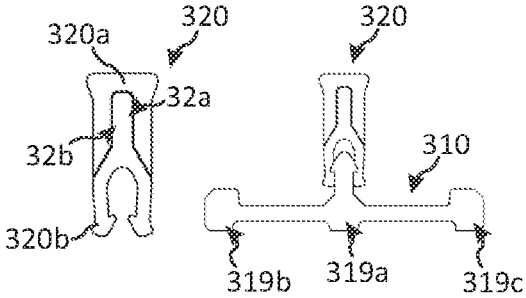
Figure 3E:
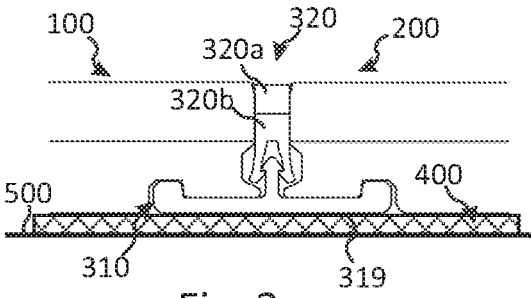

FIGS. 3*c* and 3*e* schematically illustrate perspective views and a side view of a coextruded second connecting element 320 comprising a first part 320*a* comprising a first material and a second part 320*b* comprising a second material. The first and second parts may be provided in the upper 328 and lower 329 portions of the second connecting element, respectively. Otherwise, embodiments of the first and second connecting elements may be the same as those described above and in the remaining disclosure.

FIG. 3*d* schematically illustrates in a side view a second connecting element 320 comprising a first part 320*a* comprising a first material and a second part 320*b* comprising a second material. Preferably, the first 320*a* and second 320*b* parts are coextruded, but other forms of joining them, such as by heating, welding or by an adhesive, are also part of this disclosure. As shown in FIG. 3*d*, the first part may comprise a head portion 32*a* which is received in a slot portion 32*b* of the second part.

The second material may be stiffer than the first material. The thereby stiffer head portion 32*a* may provide an improved connection to the first connecting element 310. At the same time, the less stiff second part 320*b* may compensate for dimensional tolerances between the panels 100, 200. Additionally, the stiffer head portion 32*a* may provide an improved confirmation that the first and second connecting elements are correctly connected to each other, for example by making a clicking sound.

Alternatively, or additionally, the second material may be less stretchable than the first material along the longitudinal direction of the second connecting element. By means of the thereby less stretchable head portion 32*a*, a more precise positioning of the second connecting element with respect to the first connecting element 310 may be provided. As a consequence, undesired spaces between the panels arising during installation and/or arising from environmental variations, such as temperature fluctuations or varying material properties over time, e.g., shrinkage or expansion of the material, etc. may be avoided.

Figure 3F:
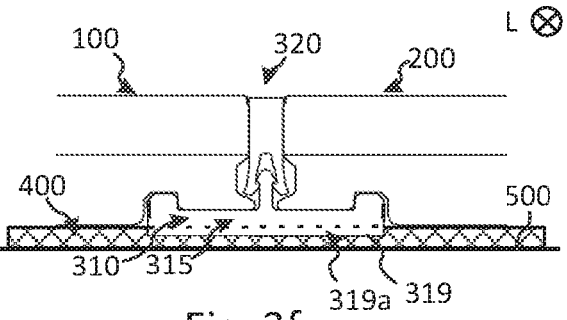
Figure 3G:
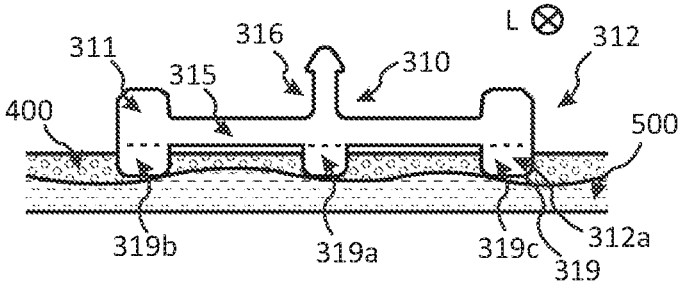
Figure 3H:
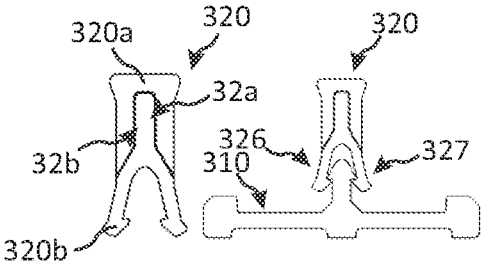

FIG. 3*h* is a schematic illustration of an embodiment of a first 310 and a second 320 connecting element similar to the one in FIG. 3*d*, whereby reference is made thereto. However, in FIG. 3*h* the second connecting element 320 comprises an expansion portion 326, 327. Embodiments of features and characteristics of the expansion portion are described elsewhere in this disclosure, e.g., in relation to FIGS. 1*a*-1*c* and 2*b*-*e*, whereby reference is made thereto.

Other features of the first and second connecting elements in FIGS. 3*d* and 3*h* may be the same as those described above and in the remaining disclosure, such as in relation to FIGS. 1*a*-1*c*, 2*a*-2*j*, 3*c* and 3*e*-3*g*.

In any of the embodiments of the present disclosure, such as in FIGS. 1*a*, 2*a*-2*j*, 3*a*-3*b*, 4*c*-4*d*, 5*a*-5*b*, 6*a*-6*d* and 7*b*-7*d*, and as embodied in cross-sectional side views in FIGS. 3*e*-3*g*, a supporting material 400, such as a compressible material or a foam, may be provided between the first connecting element and the support structure 500, such as a subfloor, preferably under the entire first 100 and second 200 panels. The support structure 500 in FIGS. 3*e*-3*f* is essentially planar while the support structure 500 in FIG. 3*g* is non-planar. In both cases, the supporting material 400 may provide a substantially planar surface to place the panels on.

In FIG. 3*e*, a backside surface 319 of the first connecting element is provided flush with the underside 102, 202 of the first and/or the second panel. A vertical extension of each locking element 311, 312 may essentially correspond to a vertical extension of the corresponding locking groove 150, 250. Moreover, in FIGS. 3*f*-3*g*, the backside surface 319 is provided below the underside 102, 202 of the first and/or the second floor panel. The vertical extension of each locking element 311, 312 may be larger than the vertical extension of the corresponding locking groove 150, 250. The vertical extension of a locking element may correspond to the distance y2 in FIG. 10*e* as described below. The vertical extension of a locking groove may be a vertical distance y0 from the underside 102, 202 of the first and/or the second panel to the upper wall 150*c*, 250*c*, see FIG. 10*e*.

Generally, in all embodiments disclosed herein, the bottom portion 315 may comprise at least one base portion 319*a*, 319*b*, 319*c*. Each base portion may elevate or level the panels with respect to the support structure 500.

In the embodiments in FIG. 3*f* and in FIGS. 3*d*, 3*g*, 3*h*, the bottom portion 315 comprises a single base portion 319*a* and three base portions 319*a*, 319*b* and 319*c*, respectively. The base portion 319*a* may be arranged under the projection 316 and the base portions 319*b*-*c* may be arranged under the locking elements 311, 312.

As illustrated by the broken lines in FIGS. 3*f*-3*g*, the base portions 319*a*-*c* may be separately formed from the first connecting element 310. Each base portion may be attached to the first connecting element, preferably to the bottom portion 315. For example, the base portions 319*a*-*c* may comprise a supporting material 400, which may be foam, felt paper, or a compressible material etc., as disclosed above.

Figure 4A:
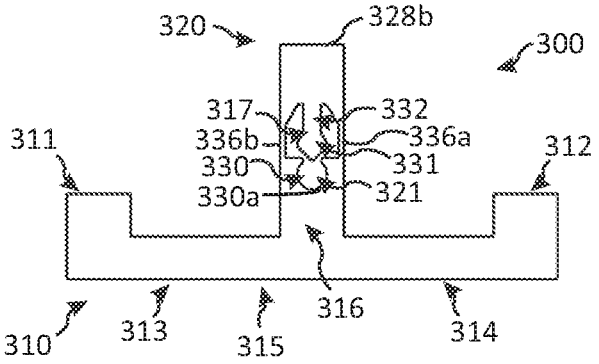
FIGS. 4*a*-4*f* illustrate in cross-sectional side views embodiments of integrally formed first and second connecting elements and their connection to panels.
Figure 4B:
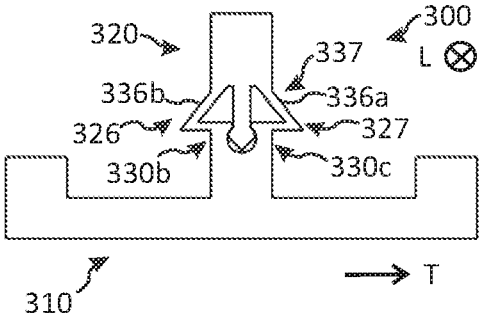

FIGS. 4*a*-4*b* illustrate in cross-sectional side views an embodiment of a connecting device 300 wherein the first 310 and second 320 connecting elements are integrally formed. Embodiments of the first 311 and second 312 locking elements are largely analogous to any of those in FIGS. 1*a*, 2*a*-2*j* and 3*a*-3*h*, whereby reference is made to the above.

FIGS. 4*a* and 4*b* illustrate the integrated connecting device 300 in a disconnected and connected state of the connecting device, respectively. The connecting device may be compressed from the disconnected state to the connected state. The compression may be accomplished by displacing the second connecting element 320 towards the first connecting element 310, for example, by exerting a pressure on the top surface 328*b*. The connecting device 300 may comprise a deformable portion 337 that may deform under the compression, preferably elastically. The deformable portion 337 may bulge transversely outwards under compression and, in particular, in the connected state. In the present embodiment, the deformable portion 337 comprises walls 336*a*, 336*b* of the integrally formed connecting device that may deform under compression, preferably elastically. The walls 336*a*, 336*b* may form a joining portion between the first 310 and the second 320 connecting elements. The deformable portion 337 forms an expansion portion 326, 327.

The first 310 and second 320 connecting elements comprise a female 321 and a male 317 connecting element, respectively. The female and the male connecting elements comprise a cavity 330 and a tip element 331, respectively, extending along the longitudinal direction L of the connecting device, preferably along its entire length. The cavity 330 is provided in a projection 316 of the first connecting element 310, e.g., between two outer wall sections 330*b-c*. The cavity may be provided above the arms 313, 314 and, optionally, above the locking elements 311, 312. Moreover, the tip element 331 is provided at an end portion of an elongated portion 332 of the second connecting element. The elongated portion 332 extends downwards. The tip element may be provided in, e.g., pressed into, the cavity 330 for obtaining a connected state of the first 310 and second 320 connecting elements. At least one of the tip element and the cavity may be flexible and/or compressible for providing the tip element in the cavity.

Figure 4C:
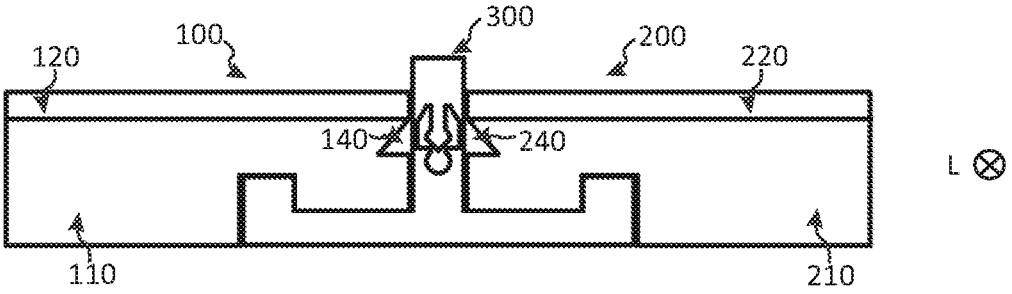
Figure 4D:
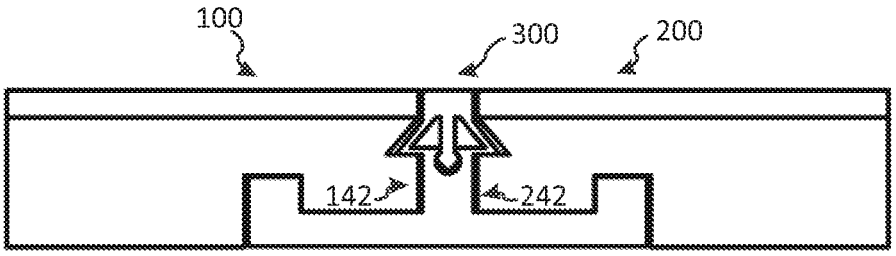

The cross-sectional side views in FIGS. 4*c* and 4*d* illustrate the integrated connecting device 300 in a disconnected and connected state of the panels, respectively. By compressing the connecting device, the horizontally connected panels in FIG. 4*c* may also become vertically connected. At least a part of the deformable portion 337 or expansion portion 326, 327 may be provided in the recesses 140, 240. A shape of the recesses 140, 240 may at least partly correspond to a shape of the deformable portion 337. In a first example, there may be a space between the second connecting element and the lower lip 142, 242 of the first and/or second panel when the panels are vertically connected. In a second example, the second connecting element may engage with each lower lip 142, 242.

Figure 4E:
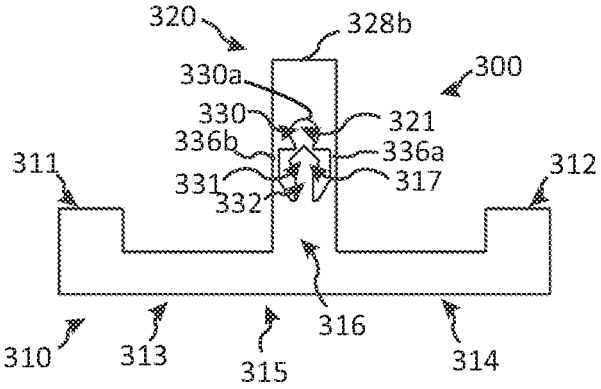
Figure 4F:
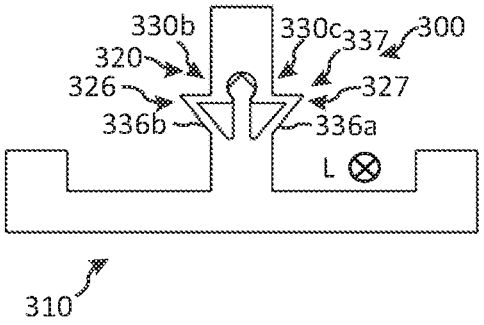

As illustrated in the cross-sectional side views in FIGS. 4*e*-4*f*, it is understood that the first 310 and second 320 connecting elements alternatively may comprise a male 317 and a female 321 connecting element, respectively. Embodiments of other features of the connecting device 300 may be similar as those described in relation to FIGS. 4*a*-4*d*, whereby reference is made to the above. In addition, it is noted that the tip element 331 is provided at an end portion of an elongated portion 332 which is provided in the projection 316 of the first connecting element 310, e.g., between two outer wall sections 330*b-c*. The elongated portion 332 extends upwards. The tip element may be provided above the arms 313, 314 and, optionally, above the locking elements 311, 312. Moreover, the cavity 330 is provided in the second connecting element.

Figure 5A:
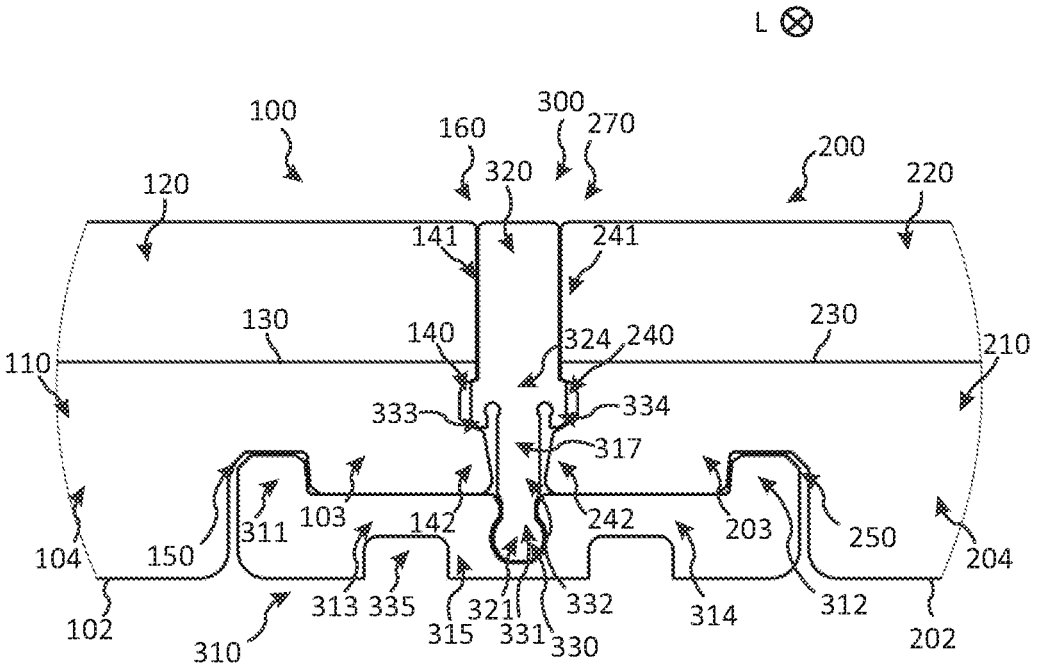
FIGS. 5*a*-5*b* illustrate embodiments of connecting devices and connected panels in cross-sectional side views.
Figure 5B:
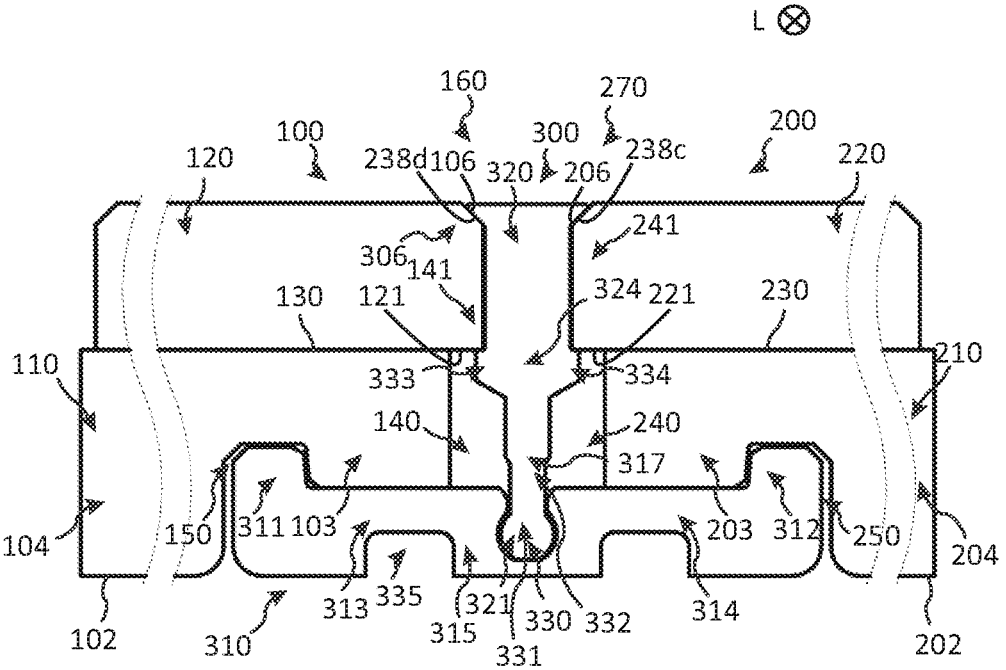

The cross-sectional side views in FIGS. 5*a*-5*b* show embodiments wherein the first connecting element 310 comprises the female connecting element 321 and the second connecting element 320 comprises the male connecting element 317. The female and the male connecting elements comprise a cavity 330 and a tip element 331, respectively, extending along the longitudinal direction L of the connecting device, preferably along its entire length. Preferably, the cavity is centred between the locking elements 311, 312. The cavity may be provided below an upper surface of the first connecting element which is configured to be provided below, in particular engage with, the outer part 103, 203 of the panels in the connected state of the panels. The outer part 103, 203 may have a smaller thickness than a thickness in an inner part 104, 204 as described above. Moreover, the tip element 331 is provided at an end portion of an elongated portion 332 of the second connecting element. The elongated portion 332 extends downwards. The tip element may be provided in, e.g., pressed into, the cavity for obtaining a connected state of the first 310 and second 320 connecting elements. A portion of the cavity may be shaped as a circle segment as seen in cross-section. At least one of the tip element and the cavity may be flexible and/or compressible for providing the tip element in the cavity.

In other aspects than the male/female connecting elements, embodiments of the first connecting element 310 for providing the horizontal connection of the panels in FIGS. 5*a*-5*b* are largely analogous to any of those in e.g., FIGS. 1*a*-1*c*, 2*a*-2*j*, 3*a*-3*h*, and 4*a*-41, whereby reference is made thereto.

In FIGS. 5*a*-5*b*, the second connecting element further comprises a first 333 and a second 334 tongue that are configured to be at least partly provided in the first 140 and second 240 recess, respectively, in the vertically connected state. The first 333 and second 334 tongues may extend horizontally, such as from a middle portion 324 or the upper portion 328, and may be provided below the top portions 105, 205, such as the surface members 120, 220, in the connected state. Optionally, they may engage with an underside 121, 221 of a respective top portion, such as a surface member. The undersides 121, 221 may be a respective lower surface of the upper lips 141, 241. The first 333 and second 334 tongues may comprise a flexible material so that they may be deformed or compressed, e.g., during connection of the second connecting element to the first connecting element when it is provided between the edge portions 160, 270.

As shown in FIG. 5*a*, the first 333 and second 334 tongues may extend in a vertical direction downwards in the vertically connected state. Thereby, the tongues may be flexible along the transverse direction T. The tongues, such an outer portion of the tongues, may engage with the recesses 140, 240, for example with the lower lips 142, 242, such as with the upper surface 143, 243, and/or with the upper lips 141, 241, such as with the lower surfaces thereof.

As shown in FIG. 5*b*, the top portion 105, 205, such as the surface member 120, 220, may comprise a chamfer portion 306 comprising a first 106 and a second 206 chamfer, and the second connecting element may comprise a bevel portion 328*a* comprising a first 328*c* and a second 328*d* bevel in complete analogy with any of the embodiments in FIGS. 2*a*-2*j*, in particular FIGS. 2*h*-2*i*. Thereby, a part of the top portion, such as the surface member, of each panel may be provided between the bevel portion 328*a* and the tongues 333, 334.

In any embodiment of this disclosure, the backside surface 319 of the first connecting element 310 may comprise at least one depression 335. For example, there may be two depressions 335 provided symmetrically on either side of the cavity 330 as in FIGS. 5*a*-5*b*.

Figure 6A:
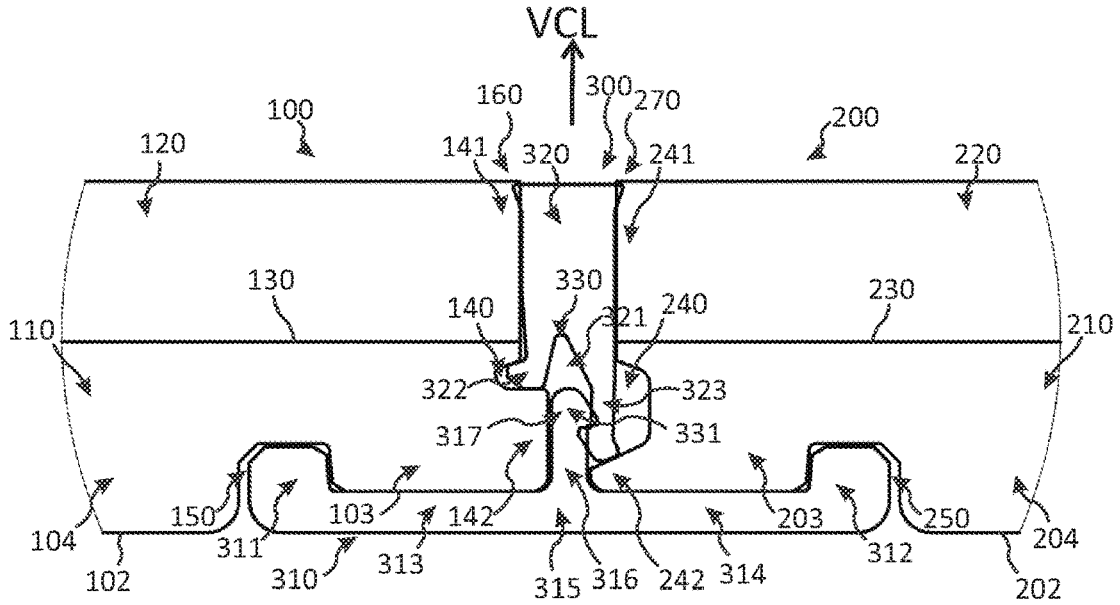
FIGS. 6*a*-6*d* illustrate embodiments of connecting devices and their connection to panels in cross-sectional side views.
Figure 6B:
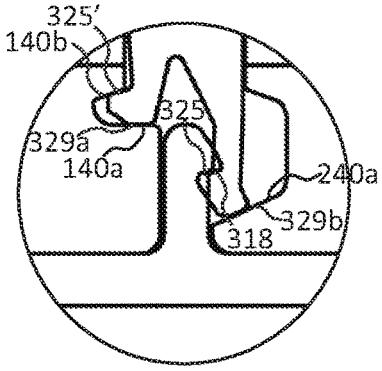
Figure 6C:
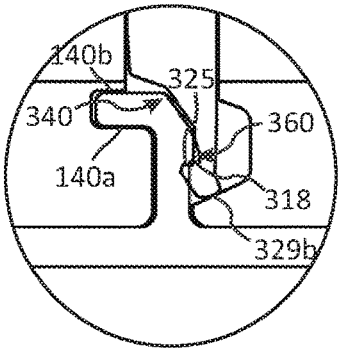

The embodiments in FIGS. 6*a*-6*d* show connecting devices 300 that are asymmetrical around a vertical centre line VCL as seen from a cross-sectional side view. FIGS. 6*b* and 6*c* are zoomed areas of FIGS. 6*a* and 6*d*, respectively.

In the embodiment shown in FIG. 6*a*, the first 310 and second 320 connecting elements comprise a male 317 and a female 321 connecting element, respectively. The male connecting element comprises a tip element 331 which is provided at an end portion of an elongated portion 332 in the form of a projection 316. The projection is provided on the first connecting element and extends vertically from the bottom portion 315. The female connecting element comprises a cavity 330. An outer portion of the tip element 331 comprises a lug element 318 comprising a single lug on only one side of the projection 316, preferably extending transversely outwards from the projection.

The female connecting element comprises a first protrusion 322 and a second protrusion 323, which is provided below the first protrusion. For example, a lowermost portion of the first protrusion may be provided above a lowermost portion of the second protrusion. The cavity 330 comprises a flange element 325 comprising a single flange. The flange element is provided at an inner portion of the second protrusion. The lug element engages with the flange element in the connected state of the first and second connecting elements.

In FIGS. 6*a*-6*b*, the recess 140 of the first panel is offset from, preferably provided above, the recess 240 of the second panel. The second connecting element, such as a lower portion 329*a* of the first protrusion 322, may engage with the lower lip 142, such as the lower wall 140*a*, in the vertically connected state. Moreover, the second connecting element, such as a lower portion 329*b* of the second protrusion 323, may engage with the lower lip 242, such as the lower wall 240*a*. Optionally, the second connecting element, such as a flange member 325' of the first protrusion 322, may engage with the upper lip 141, such as the upper wall 140*b*. The flange member 325' may comprise a flange provided at an outer portion of the first protrusion. The projection 316 may engage with any of or both lower lips 142, 242.

In other aspects than the male/female connecting elements, embodiments of the first connecting element 310 for providing the horizontal connection of the panels in FIGS. 6*a*-6*d* are largely analogous to any of those in FIGS. 1*a*-1*c*, 2*a*-2*j*, 3*a*-3*h*, 4*a*-4*f*, and 5*a*-5*b*, whereby reference is made thereto.

Figure 6D:
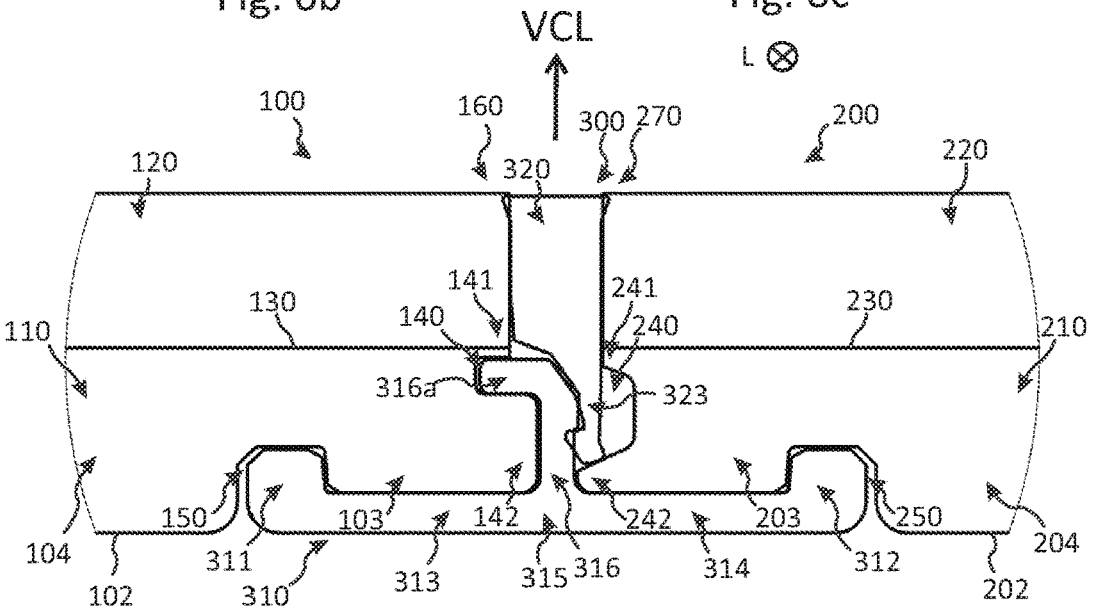

In the embodiments shown in the cross-sectional side views in FIGS. 6*c*-6*d*, the first connecting element 310 comprises a protuberant portion 316*a* that is configured to be provided in the recess 140 for vertically connecting the first connecting element to the first panel at least in one vertical direction. Preferably, the first connecting element is connected to the first panel also in an opposite vertical direction by means of an engagement between the first arm portion 313 and the underside 103*a* of the outer part 103. The protuberant portion 316*a* may extend horizontally from the projection 316 and may engage with the lower 140*a* and/or upper 140*b* wall of the recess 140. The first connecting element may also be horizontally connected to the first panel by means of the first locking element 311 being provided in the locking groove 150, and optionally an engagement between the lower lip 142 and the projection 316. The first connecting element may be pre-connected to the first panel when providing the panel on the support structure.

Moreover, the second connecting element 320 comprises at least one protrusion, preferably a single protrusion 323, which is configured to engage with a portion of the projection 316 for vertically connecting the first and second connecting elements and the panels. A flange element 325 comprising a single flange may be provided at an inner portion of the protrusion 323. The projection may comprise a lug element 318, preferably comprising a single lug on only one side of the projection. The lug element may be provided in an indentation 360 of the projection, preferably facing the second panel 200. Alternatively, the lug element may be provided as in FIGS. 6*a*-6*b*, extending transversely outwards from the projection. The lug element 318 may engage with the flange element 325 in the connected state of the first and second connecting elements. Optionally, the second connecting element, such as a lower portion 329*b* of the single protrusion 323, may engage with the lower lip 242, such as the lower wall 240*a*, in the vertically connected state. Moreover, the second connecting element 320 may comprise a transversely open portion 340 for housing a portion of the projection 316 and/or a portion of the protuberant portion 316*a*. The transversely open portion 340 may be open in a, preferably horizontal, direction towards the first panel 100 in the connected state.

In any of the embodiments described above in FIGS. 1*a*-1*c*, 2*a*-2*j*, 3*a*-3*h*, 4*a*-4*f*, 5*a*-5*b* and 6*a*-6*d*, the second connecting element may be arranged with pretension between the first 100 and second 200 panels. A distance between the top portions 105, 205, such as the surface members, in the connected state may be smaller than a transversal width of an engagement portion of the second connecting element 320, e.g., provided in the upper portion 328, in a disconnected state. The engagement portion may be provided below the bevel portion 328*a*, when present.

In some embodiments, and as shown in FIG. 1*a*, 2*d*-2*j*, 3*b*, 3*d*-3*f*, 3*h* and 6*a*-6*b*, an innermost portion 330*a* of the cavity 330 may be separated from the elongated portion 332 in the connected state. In some embodiments, and as shown in FIGS. 4*b*, 4*d*, 4*f* and, 5*a*-5*b*, the innermost portion 330*a* of the cavity 330 may engage with the elongated portion 332 in the connected state.

As shown in FIG. 2*e*, the second connecting element 320 may comprise a hole 301, such as an interior hole. Preferably, the hole 301 is provided in the upper 328 or middle 324 portion and may extend along the entire longitudinal extension L. By means of the hole, material may be saved. Additionally, the hole may provide the increased transversal width of the upper portion 328 towards the top surface 328*b* as described above. By way of example, the absence of material may cause at least one wall 301*a* enclosing the hole to collapse transversely inwardly.

FIGS. 7*a*-7*d* show embodiments in cross-sectional side views, wherein the second connecting element 320 comprises or is made of a curable material 350. The curable material may be a grouting material or a flexible curable material. The panels 100, 200 in FIGS. 7*a*-7*b* and 7*d* comprise a surface member 120 bonded to a support member 110, while the panels 100, 200 in FIG. 7*c* are made of a solid material.

Figure 7A:
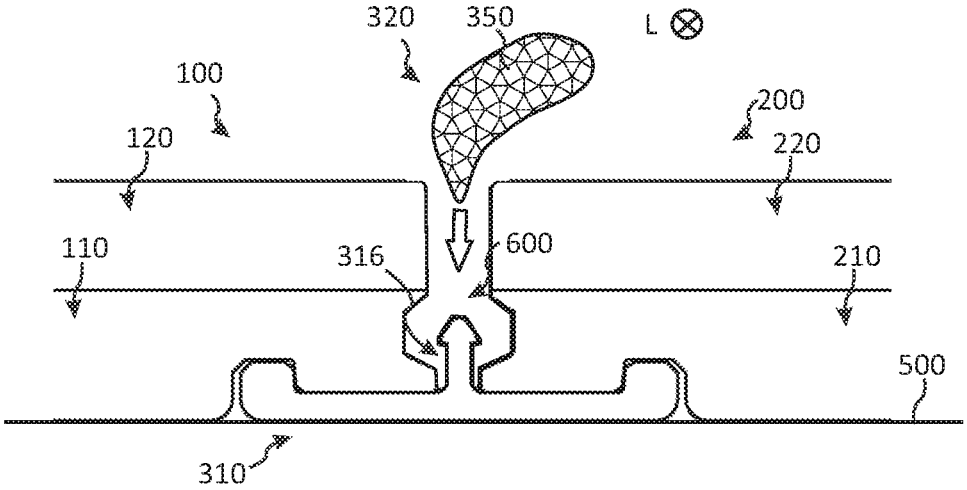
FIGS. 7*a*-7*d* illustrate cross-sectional side views of embodiments of connected panels, wherein the second connecting element is made of a curable material.
Figure 7B:
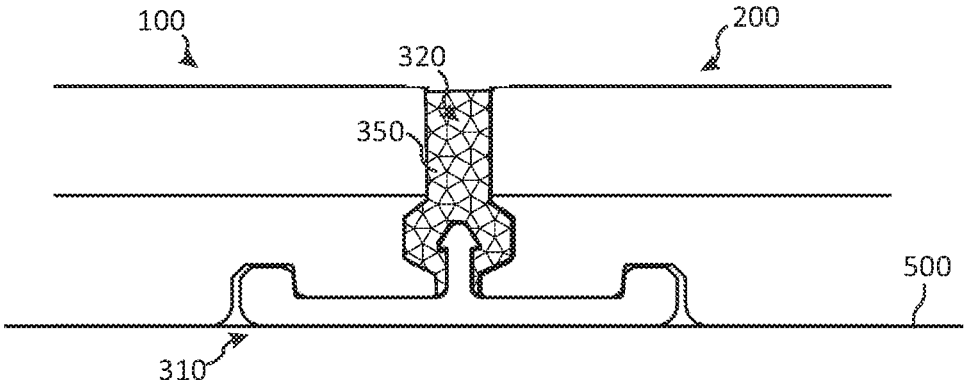
Figure 7C:
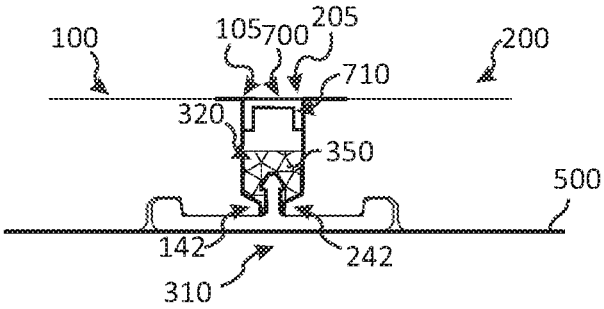
Figure 7D:
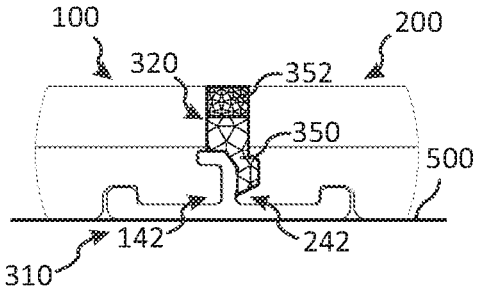

FIG. 7*a* illustrates how the curable material 350 is inserted between the two panels 100, 200 that are provided on a subfloor 500 and that are horizontally connected to each other by the first connecting element 310 in accordance with any of the embodiments described in the present disclosure. The curable material 350 is inserted into a space 600 defined between the panels and the first connecting element and extending along the longitudinal direction L. The curable material 350 may completely fill the space 600 as shown in FIG. 7*b*, or may partly fill the space 600 as shown in FIGS. 7*c*-7*d*. Preferably, the curable material 350 completely covers the projection 316. The curable material is cured. Thereby, curable material provided between the lower lips 142, 242 and the tip element 331 may provide the vertical connection. Alternatively, or additionally, curable material which bonds portions of the first connecting element 310 and the first 100 and second 200 panels may provide the vertical connection.

FIG. 7*d* illustrates an embodiment wherein the second connecting element 320 comprises a first curable material 350 and further comprises a second curable material 352. The first material 350 may be used for connecting the panels, and the second material 352 may be decorative. Optionally, as shown in FIG. 7*c*, a decorative strip 700 may be provided between the top portions 105, 205 of the panels. The decorative strip 700 may comprise wings 710 which may extend downwards. Clearly, the decorative strip may extend along the longitudinal direction L.

In some embodiments, the first and second connecting elements are formed as strips or clips as in any of the embodiments in FIGS. 1*a*-1*c*, 2*a*-2*j*, 3*a*-3*h*, 4*a*-4*d*, 5*a*-5*b*, and 6*a*-6*d*, and the second connecting element further comprises a curable material 350, e.g., for providing an improved connection and/or reducing squeak. The curable material may be provided on the first and/or second connecting elements, preferably before connection. The curable material may be provided on portions that are configured to engage with each other when connected, such as the lug element 318 and the flange element 325. In one example, the curable material comprises a two-component adhesive. Thereby, a first and a second component may be provided on the first and the second connecting element, respectively.

It is emphasized that any of the embodiments of the first and/or the second connecting element described above in relation to FIGS. 1*a*-1*c*, 2*a*-2*j*, 3*a*-3*h*, 5*a*-5*b*, and 6*a*-6*d*, or of the first connecting element in relation to 7*a*-*d*, may be formed from a metal, such as aluminium. Clearly, and as discussed above, in some embodiments these first and second connecting elements may comprise an elastomer, a rubber, a thermoplastic or a thermoset.

The first and the second panels may have the same format and may have essentially identical connecting geometries along a circumferential edge portion 160, 170, 180, 190 and 260, 270, 280, 290 of the first 100 and second 200 panel, respectively. FIGS. 8*a*-8*b* and 8*c*-8*d* illustrate embodiments of a first 100 or a second 200 panel that may be used in combination with any of the embodiments of the connecting device and edge regions described in the disclosure. It is understood that the panels 100, 200 in FIGS. 8*a*-8*d* may be made of a solid material or may comprise a surface member bonded to a support member.

Figure 8A:
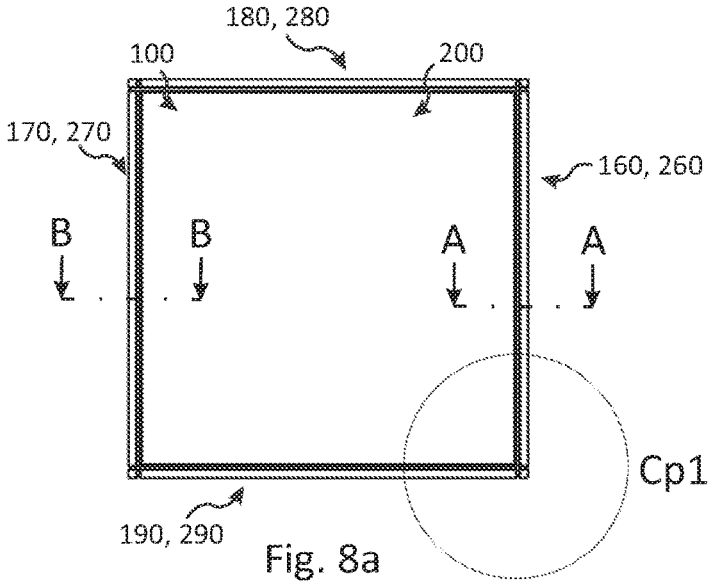
FIGS. 8*a*-8*d* illustrate embodiments of a panel in bottom views and perspective views.
Figure 8B:
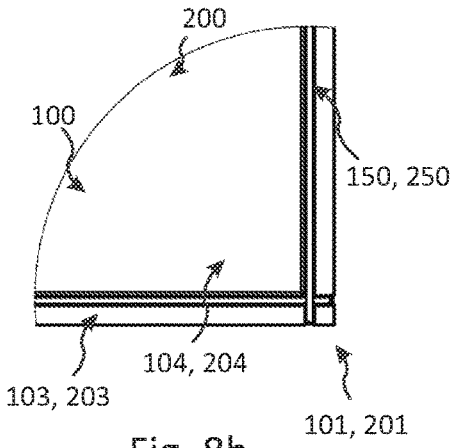
Figure 8C:
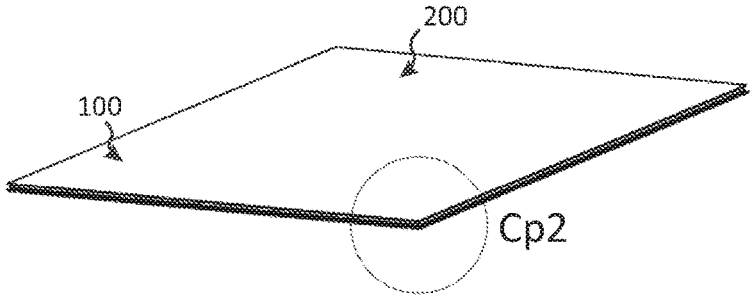
Figure 8D:
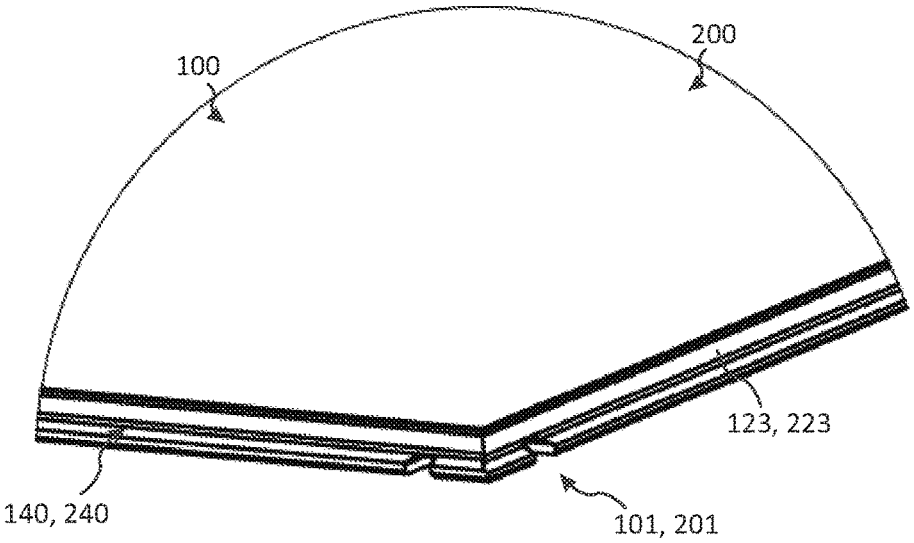

FIG. 8*a* is a bottom view of the panel 100, 200 and FIG. 8*b* is a corner region Cp1 thereof. FIG. 8*c* is a perspective top view of the panel and FIG. 8*b* is a corner region Cp1 thereof. The cross-sectional side views A-A and B-B in FIG. 8*a* may illustrate the first 100 and second 200 panels in FIG. 1*a*, respectively. Locking grooves 150, 250 and recesses 140, 240 are provided in each edge portion 160, 170, 180, 190 and 260, 270, 280, 290 of the panels. The locking grooves 150, 250 and the recesses 140, 240 each extend to the side edges of each panel. The recesses and locking grooves arranged in two perpendicular edge portions overlap each other in the each of the four corner portions 101 and 201 of the first and second panel, respectively.

Figure 9A:
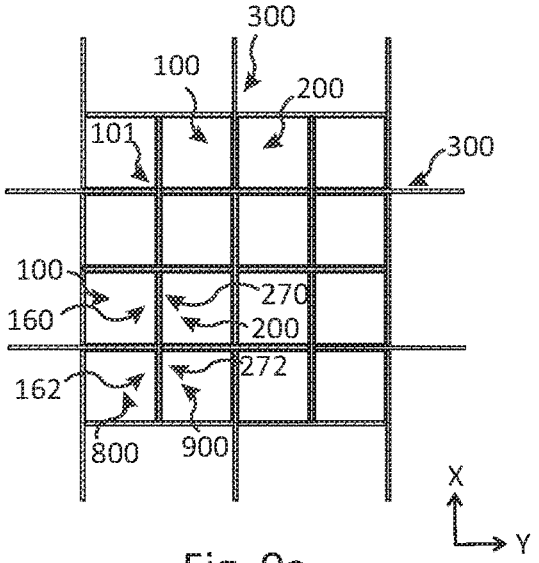
FIGS. 9*a*-9*e* illustrate embodiments of flooring systems comprising square and rectangular panels in bottom views and a top view.
Figure 9B:
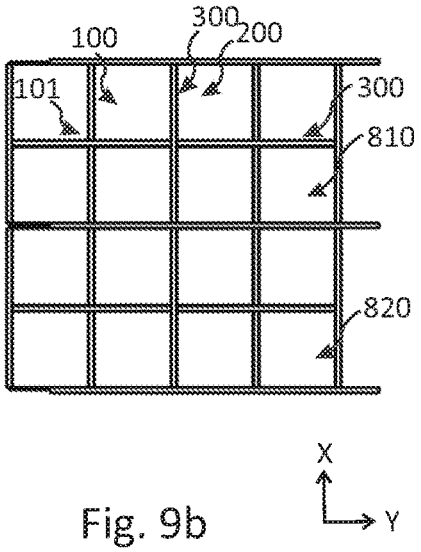
Figure 9C:
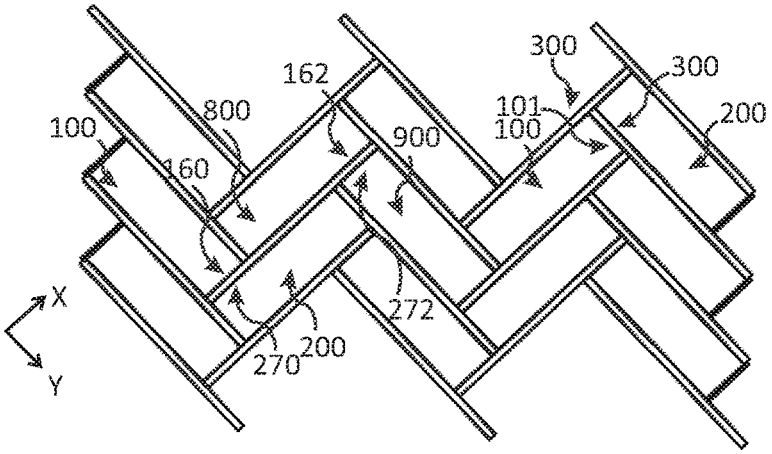

An advantage of an embodiment of the present inventive concept is that the connecting system may be used for any type of panel patterns, as long as the panels jointly form a continuous floor surface together with the connecting devices, in particular with their top surfaces 328*b*. In particular, different sizes, formats and arrangements of the panels may be used. Moreover, the panels may be connected to each other in any order. FIGS. 9*a*-9*c* illustrate in bottom views embodiments of flooring systems comprising square and rectangular panels that are provided on a support structure and that are interconnected coplanarly. Top sides 122, 222 of the panels may have the dimensions 200-1500 mm times 100-1000 mm, such as 300×600 mm or 1000×200 mm in the case of rectangular panels, or 300×300 mm or 600×600 mm in the case of square panels.

Embodiments of pairs of connected panels along any of the two perpendicular horizontal directions X and Y in these figures may be implemented by any embodiment in this disclosure along the horizontal direction H. The panels in FIGS. 9*a* and 9*c* are interconnected in the directions X and Y such that all panels are displaceable as a single unit. The panels in FIG. 9*b* comprise two subsets of panels 810, 820 which each are displaceable as a single unit. The subsets 810, 820 are displaceable relative each other in a single horizontal direction Y. Optionally, the subsets 810, 820 may be connected to each other in the direction Y, e.g., by connecting them to other panels, such as similar subsets.

FIGS. 9*a*-9*c* show connecting devices 300 that extend along edge portions of at least two pairs of panels in the connected state. FIG. 9*b* also shows connecting devices 300 that extend along edge portions of a single pair of panels. The flooring systems in FIGS. 9*a*-9*b* comprise square panels 100, 200 that are arranged in a linear or diamond pattern. The flooring system FIG. 9*c* comprises rectangular panels that are arranged in a herringbone pattern. In FIGS. 9*a* and 9*c*, the connecting devices 300, such as the first 310 and/or second 320 connecting elements, may have the same, or essentially the same, longitudinal length. The longitudinal length may be approximately two panel lengths as measured along two perpendicular panel edges. In FIG. 9*b*, the connecting devices, such as the first and/or second connecting elements, may have different longitudinal lengths.

In FIGS. 9*a*-9*c*, some connecting devices extend along edge portions 160, 270 of a first pair of panels, such as the first 100 and second 200 panels, as well as along edge portions 162, 272 of a second pair of panels, such as a third 800 and a fourth 900 panel. The third 800 and fourth 900 panels may be connected to each other in a similar manner as in any of the embodiments in this disclosure describing the connection of the first and second panels. Clearly, other pairs of panels, such as 100 and 800, 200 and 900, and 200 and 800, may be connected to each other in a similar manner.

Figure 9D:
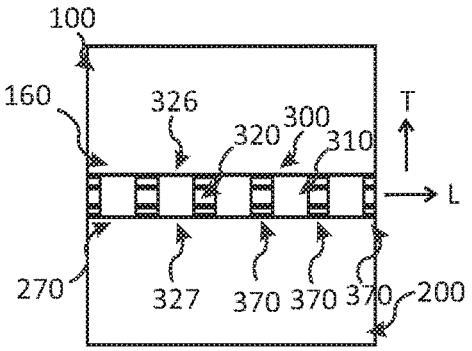
Figure 9E:
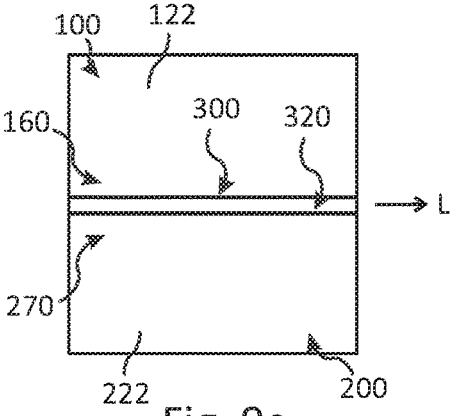

FIGS. 9*d* and 9*e* illustrate in a bottom view and a top view, respectively, an embodiment of a flooring system wherein the connecting device 300 comprises a single second connecting element 320 and at least two, in particular a plurality, of first connecting elements 310. Thereby, material may be saved. The longitudinal extension of the second connecting element is larger than a longitudinal extension of the first connecting element. Each first connecting element extends along a portion of the edge portions of the first and second panels and the second connecting element extends along a larger edge portion, such as an entire edge portion, of the panels.

Figure 10A:
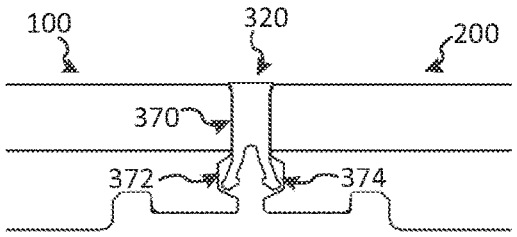
FIG. 10*a* illustrates a cross-sectional side view of an embodiments of connected panels.

In the connected state, the second connecting element 320 in FIGS. 9*d*-9*e* may comprise intermediate portions 370 located between pairs of, or being adjacent to, first connecting elements 310 along the longitudinal direction L. There may be an intermediate portion 370 at one or both ends of the second connecting element. FIG. 10*a* is a side view of an embodiment illustrating an intermediate portion 370 where there locally is no first connecting element connected to the second connecting element.

The connecting device 300 may comprise an expansion portion 326, 327 that is configured to expand outwards in the transverse direction T in accordance with any embodiment described in this disclosure. The expansion portion may be located along the longitudinal direction L where both first and second connecting elements are provided. The expansion portion 326, 327 may be configured to at least partly expand the intermediate portions 370 of the second connecting element 320 in the transverse direction T. An intermediate portion may be adjacent to one expansion portion 326, 327 (e.g., at an end of the second connecting element) or two expansion portions 326, 327 (e.g., away from the ends of the second connecting element). Thereby, also each intermediate portion may comprise an intermediate expansion portion 372, 374. Since the intermediate expansion portion may be adjacent to one or two expansion portions, the intermediate expansion portion may also expand. As shown in FIG. 10*a*, each intermediate expansion portion may be at least partly provided in a respective recess 140, 240 in the vertically connected state analogous to the expansion portion as described above. Thereby, an increased vertical connection of the panels may be provided.

In some embodiments, at least one first connecting element 310 may be used in a first stage as a temporary horizontal connection of the panels in a flooring system. Optionally, the first connecting elements may also level the panels relative to each other. A final connection of the panels may be provided in a second stage where at least one second connecting element 320 cooperates with the first connecting elements. In some embodiments, the first and second connecting elements are formed as strips or clips. In another embodiment, the second connecting element is made of a curable material as described above.

Figure 10B:
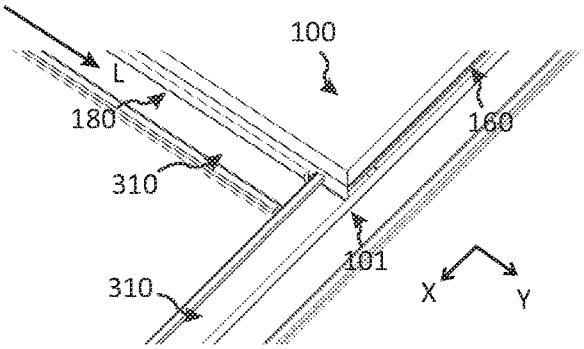
FIGS. 10*b*-10*e* illustrate embodiments of two perpendicularly arranged connecting devices in top perspective views and embodiments of connected panels in side views.
Figure 10C:
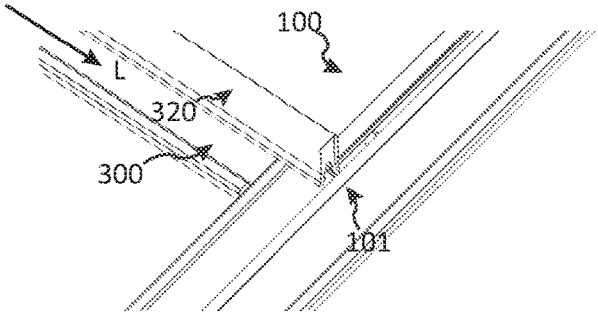
Figure 10D:
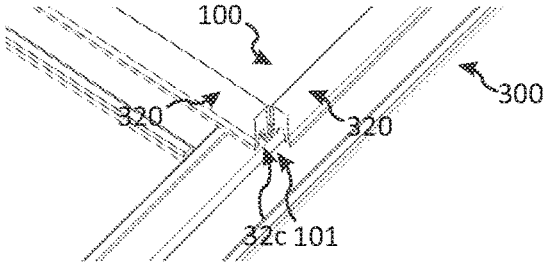

FIGS. 10*b*-10*d* illustrate in top perspective views embodiments of a corner portion 101 of a first panel 100, wherein two connecting devices 300 are arranged perpendicularly to each other and are arranged along an edge portion 160 and a perpendicular edge portion 180, respectively. Such a corner portion 101 is indicated in each of FIGS. 9*a*-9*c*, It is understood that a second panel 200 and a third panel 800 may be connected to the first panel 100 along the edge portions 160, 180.

FIG. 10*b* shows first connecting elements 310 that are arranged perpendicularly to each other along the edge portions 160, 180. The first connecting element 310 arranged along the edge portion 160 extends beyond the corner portion 101 along the X direction, and the first connecting element 310 arranged along the edge portion 180 is arranged inside the corner portion 101 along the Y direction. As shown in FIG. 10*c*, a second connecting element 320 arranged along the edge portion 180 may be connected to the first connecting element 310 provided along the edge portion 180 and may extend beyond it along the longitudinal direction L of the connecting device 300. Finally, FIG. 10*d* illustrates how a second connecting element 320 arranged along the edge portion 160 may be connected to the first connecting element 310 provided along the edge portion 160. In particular, the first connecting elements provided along the edge portions 160, 180 may meet, optionally make contact with each other, in the corner portion 101. It is understood that FIG. 10*d* is schematic and that the second connecting element 320 along the edge portion 160 may extend beyond an end 32*c* of the second connecting element 320 along the edge portion 180, such as illustrated in FIGS. 9*a*-9*c*.

Figure 10E:
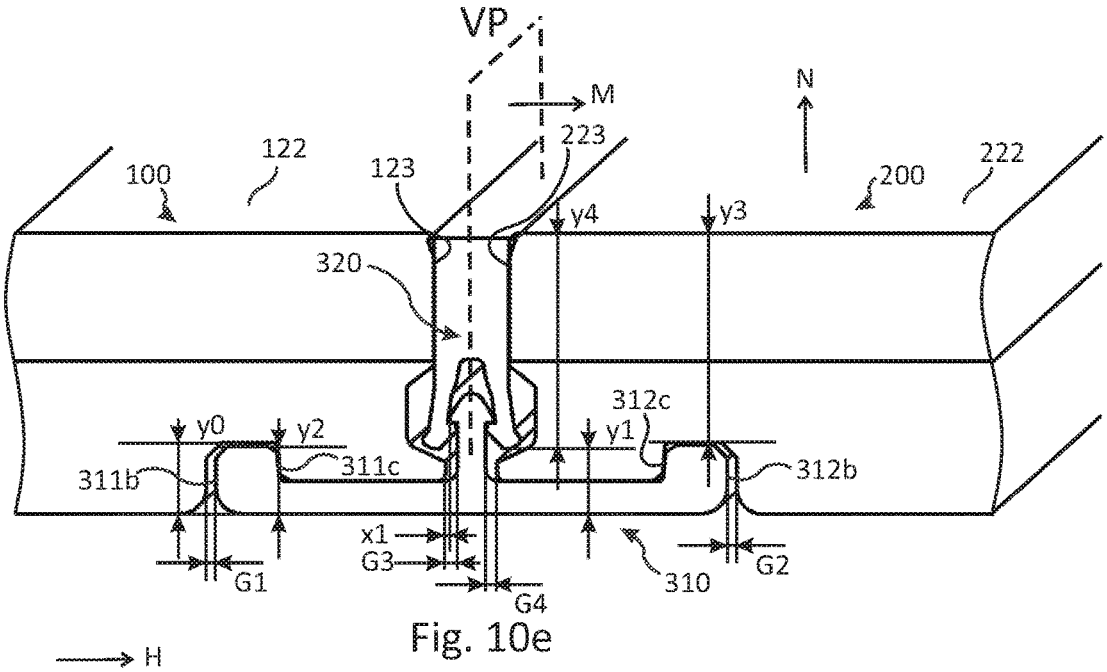

The embodiment FIG. 10*e* illustrates how the second connecting element 320 of a first connecting device 300 may be provided above the first connecting element 310 of a second connecting device 300 as shown in FIGS. 10*c*-10*d*. A vertical distance y1 from an underside of the first connecting element 310 to the lowermost surface of the second connecting element 320 may be essentially equal or larger than a vertical distance y2 from the underside of the first connecting element to the uppermost surface of any or both of the locking elements 311, 312. Alternatively, or additionally, a vertical distance y3 from a top side 122, 222 of the first and/or the second panel to the upper wall 150*c*, 250*c* of the respective locking groove may be essentially equal or larger than a vertical distance y4 from the top side 122, 222 to the lowermost surface of the second connecting element. It is clear that the relations between the distances (y1, y2) and/or (y3, y4) may hold for the second connecting element 320 of a first connecting device 300 and the first connecting element 310 of a second connecting device 300 as described above.

In any of the embodiments above, the connecting device 300 and the panels 100, 200 preferably are configured such that, in a vertically disconnected state of the first or the second panel, the first and/or the second panel is removable from the connecting device, by a vertical displacement of the panel. FIG. 10*e* illustrates an embodiment wherein each panel is removable from the connecting device by a vertical displacement of the panel only, without any angling. In this embodiment, when the second connecting element 320 is removed, an outermost portion of each side edge 123, 223 may be horizontally spaced or essentially aligned with the projection 316, such as a respective outermost portion of the projection. For example, a horizontal distance x1 between the projection, such as the tip element 311, and the side edge 123, such as the upper 141 or lower 142 lip, may be essentially zero or larger than zero. Similarly, a horizontal distance between the projection, such as the tip element, and the side edge 223, such as the upper 241 or lower 242 lip, may be essentially zero or larger than zero. It other embodiments, there may also be an angular displacement of the first or the second panel.

As shown in e.g., FIG. 10*e*, there may be a gap G1 between the inner wall 150*a* of the locking groove 150 and an outer wall 311*b* of the first locking element 311 and/or a gap G2 between the inner wall 250*a* of the locking groove 250 and an outer wall 312*b* of the second locking element 312. Thereby, the locking groove 150, 250 may be more easily provided in engagement and/or disengagement with the locking element 311, 312. Alternatively, or additionally, there may be a gap G3 between the side edge 123, such as the lower lip 142, and the projection 316 and/or a gap G4 between the side edge 223, such as the lower lip 242, and the projection 316. By connecting the second connecting element to the first connecting element, the panels 100, 200 may be displaced outwards, for example by an engagement between the second connecting element and the top portions 105, 205, such that the outer wall 150*b* comes into contact with an inner wall 311*c* of the first locking element and/or such that the outer wall 250*b* comes into contact with an inner wall 312*c* of the second locking element. Thereby, a final horizontal locking may be provided. It is understood that any, each or some of the gaps G1, G2, G3 and G4 are equally possible in any other embodiment of the present disclosure.

The inventive concept has mainly been described above with reference to a few embodiments. However, as is readily appreciated by a person skilled in the art, other embodiments than the ones disclosed above are equally possible within the scope of the invention, as defined by the appended patent claims and an embodiment section provided below. For instance, the expansion portion 326, 327 may be provided in a coextruded connecting device as that in FIGS. 3*c* and 3*e* comprising a first and a second material, optionally having different characteristics. Also, at least one base portion 319*a*-*c* may be provided on any first connecting element 310 in this disclosure. Moreover, throughout the disclosure, each panel in a flooring system may comprise a surface member 120 bonded to a support member 110, or it may be made of a solid material. Also, the embodiments described above are equally applicable to embodiments of the connecting device 300 per se in accordance with the second aspect as well as to embodiments of the aspects provided below in the embodiment section.

Embodiments

Further embodiments of the first and second aspects of the inventive concept are provided below. Reference is made to the above for a detailed description of embodiments of these aspects.

Item 1. A flooring system comprising floor panels (100, 200) and a connecting system for connecting the floor panels, wherein the flooring system comprises:

a first floor panel (100) and a second floor panel (200), and a connecting device (300) comprising a first connecting element (310) and a second connecting element (320), wherein the first connecting element is configured to cooperate with the first floor panel and the second floor panel for horizontally connecting the first floor panel and the second floor panel, and wherein the second connecting element is configured to cooperate with the first connecting element for vertically connecting the first floor panel and the second floor panel.

Item 2. The flooring system according to item 1, wherein the first connecting element comprises a first locking element (311) configured to engage with a locking groove (150) provided in an underside of the first floor panel and a second locking element (312) configured to engage with a locking groove (250) provided in an underside of the second floor panel.

Item 3. The flooring system according to item 2, wherein the locking groove provided in the first floor panel and/or the locking groove provided in the second floor panel is horizontally spaced inwardly from an edge portion (160, 270), such as a side edge (123, 223), of the first floor panel and the second floor panel, respectively.

Item 4. The flooring system according to any of items 1-3, wherein a backside surface (319) of the first connecting element is configured to be provided below or flush with an underside (102, 202) of the first and/or the second floor panel when the first and second floor panels are horizontally connected.

Item 5. The flooring system according to any of items 1-4, wherein each floor panel comprises a support member (110, 210) and a surface member (120, 220) which is bonded to the support member.

Item 6. The flooring system according to item 5, wherein the surface member comprises ceramic, porcelain, natural stone, artificial stone, marble, glass, or a mineral material.

Item 7. The flooring system according to item 5 or 6, wherein the support member comprises a thermoplastic, such as vinyl or PVC, and, optionally, a filler, such as at least one selected from the group of fibres, for example wood fibres or cellulose fibres, stone material, for example stone powder, and mineral material, or wherein the support member comprises a thermoset, and, optionally, a filler, such as fibres, e.g., wood fibres or cellulose fibres.

Item 8. The flooring system according to any of items 5-7, wherein an intermediate member (130, 230) is provided between the support member and the surface member.

Item 9. The flooring system according to any of items 1-4, wherein each floor panel is made of a solid material, such as a ceramic material or a wood material.

Item 10. The flooring system according to any of items 1-9, wherein an edge portion (160, 270) of the first floor panel and/or the second floor panel comprises a recess (140, 240).

Item 11. The flooring system according to item 10, wherein the recess of the first and/or second floor panel is provided below an upper lip (141, 241) and/or above a lower lip (142, 242) provided in the edge portion, the lower lip preferably comprising an inclined upper surface (143, 243).

Item 12. The flooring system according to item 11, wherein:

the lower lip extends horizontally beyond the upper lip, the upper lip extends horizontally beyond the lower lip, or the lower lip has the same horizontal extension as the upper lip.

Item 13. The flooring system according to item 11 or 12, wherein the second connecting element is configured to be spaced from the lower lip of the first and/or second panel when the first and second panels are vertically connected.

Item 14. The flooring system according to item 11 or 12, wherein the second connecting element is configured to engage with the first and/or second panel, such as with a lower lip of the first and/or second panel, when the first and second panels are vertically connected.

Item 15. The flooring system according to any of items 10-14, wherein an expansion portion (326, 327) of the connecting device is configured to be at least partly provided in the recess of the first and/or second floor panel when the first and second connecting elements are cooperating.

Item 16. The flooring system according to item 15, wherein said expansion portion is further configured to expand during connection of the first and second connecting elements, such as when the second connecting element is displaced towards the first connecting element.

Item 17. The flooring system according to any of items 1-16, wherein the first floor panel and/or the second floor panel comprises a holding portion (144, 244) for holding the second connecting element in position.

Item 18. The flooring system according to any of items 1-17, wherein each of the first and second floor panels comprises a first pair of opposing edge portions (160, 170; 260, 270) and a second pair of opposing edge portions (180, 190; 280, 290).

Item 19. The flooring system according to any of items 1-18, wherein a connecting geometry is essentially identical along a circumferential edge portion (160, 170, 180, 190; 260, 270, 280, 290) of each of the first floor panel and second floor panel.

Item 20. The flooring system according to item 19, wherein the connecting geometry of the first floor panel is essentially identical to the connecting geometry of the second floor panel.

Item 21. The flooring system according to any of items 1-20, wherein in a connected state of the first and second floor panels, the first and the second floor panels are configured to be vertically displaceable relative to each other, between a first vertical position and a second vertical position, while maintaining the vertical connection.

Item 22. The flooring system according to any of items 1-21, wherein the floor panels are configured to be floating when connected.

Item 23. The flooring system according to any of items 1-22, wherein the connecting device comprises a male connecting element (317) and a female connecting element (321), the male connecting element being configured to engage with the female connecting element for providing said vertical connection.

Item 24. The flooring system according to item 23, wherein the male connecting element is provided in the first connecting element and the female connecting element is provided in the second connecting element.

Item 25. The flooring system according to item 23, wherein the male connecting element is provided in the second connecting element and the female connecting element is provided in the first connecting element.

Item 26. The flooring system according to any of items 1-25, wherein the first connecting element and the second connecting element are separately formed.

Item 27. The flooring system according to any of items 1-25, wherein the first connecting element and the second connecting element are integrally formed.

Item 28. The flooring system according to any of items 1-27, wherein the first connecting element and/or the second connecting element at least partially, preferably completely, is formed of an elastomer, a rubber, a thermoplastic, or a thermoset.

Item 29. The flooring system according to any of items 1-28, wherein the first connecting element and/or the second connecting element is extruded, coextruded, 3D printed or injection moulded.

Item 30. The flooring system according to any of items 1-27, wherein the second connecting element comprises a curable material (350), such as a grouting material, for example a cement-based grouting material, or a flexible curable material, such as an elastomer, or wherein the second connecting element comprises a metal, such as aluminium.

Item 31. The flooring system according to any of items 1-29, wherein the first connecting element and the second connecting element are configured to be connected to each other by snapping.

Item 32. The flooring system according to any of items 1-31, wherein the connecting device is symmetrical around a vertical centre line as seen from a cross-sectional side view of the connecting device.

Item 33. The flooring system according to any of items 1-31, wherein the connecting device is asymmetrical around a vertical centre line as seen from a cross-sectional side view of the connecting device.

Item 34. The flooring system according to any of items 1-33, wherein an upper portion (328) of the second connecting element is configured to engage with a top portion (105, 205), such as a surface member (110, 210), of each of the first and second floor panels, when the first and second panels are vertically connected.

Item 35. The flooring system according to any of items 1-34, wherein a top portion (105, 205), such as a surface member (110, 210), of each of the first and the second floor panels comprises a chamfer portion (306), and/or wherein the second connecting element comprises a bevel portion (328*a*).

Item 36. The flooring system according any of items 1-35, wherein the second connecting element is arranged with pretension between the first and second floor panels.

Item 37. The flooring system according to any of items 1-36, wherein the connecting device, preferably each of the first and the second connecting elements, is configured to extend along an entire edge portion of the first and second panels when the first and second panels are horizontally and vertically connected.

Item 38. The flooring system according to any of items 1-36, wherein a longitudinal extension of the second connecting element is larger than a longitudinal extension of the first connecting element.

Item 39. The flooring system according to any of items 1-38, wherein the second connecting element, such as a lower portion (329) of the second connecting element, is configured to be spaced from each of the first and second floor panels, such as each support member of the first and second floor panels, when the first and second panels are vertically connected.

Item 40. The flooring system according to any of items 1-39, wherein the connecting device, preferably the second connecting element, is configured to be operable in a connected state of the first and second floor panels for vertically disconnecting the first and second floor panel.

Item 41. The flooring system according to any of items 1-40, wherein the connecting device and the first and/or second floor panel are configured such that, in a vertically disconnected state of the first or the second panel, such as when the second connecting element is disconnected from the first connecting element, the first and/or the second floor panel is removable from the connecting device, preferably by a vertical displacement of the first and/or the second floor panel.

Item 42. The flooring system according to any of items 1-41, comprising a connecting device (300) according to any of items 43-64.

Item 43. A connecting device (300) for connecting a first floor panel (100) and a second floor panel (200), wherein the connecting device comprises:

a first connecting element (310) and a second connecting element (320), wherein the first connecting element is configured to cooperate with the first floor panel and the second floor panel for horizontally connecting the first floor panel to the second floor panel, and wherein the second connecting element is configured to cooperate with the first connecting element for vertically connecting the first floor panel and the second floor panel to the connecting device.

Item 44. The connecting device according to item 43, wherein the first connecting element comprises a first locking element (311) and a second locking element (312).

Item 45. The connecting device according to item 43 or 44, wherein the connecting device comprises an expansion portion (326, 327) configured to be at least partly provided in a recess (140, 240) provided in an edge portion (160, 270) of the first floor panel and/or the second floor panel when the first and second connecting elements are cooperating.

Item 46. The connecting device according to item 45, wherein said expansion portion is further configured to expand during connection of the first and second connecting elements.

Item 47. The connecting device according to item 45 or 46, wherein the expansion portion is provided in the second connecting element, such as in a lower portion (329) of the second connecting element.

Item 48. The connecting device according to any of items 45-47, wherein the expansion portion is configured to expand when the second connecting element engages with the first connecting element.

Item 49. The connecting device according to any of items 45-48, wherein the expansion portion is configured to expand when the second connecting element is displaced, such as towards the first connecting element.

Item 50. The connecting device according to any of items 45-49, wherein the expansion portion is provided as a deformable portion (337), such as deformable walls (336*a*, 336*b*), of the connecting device.

Item 51. The connecting device according to any of items 45-50, wherein the expansion portion is configured to expand in a transverse direction of the connecting device.

Item 52. The connecting device according to any of items 45-51, wherein the expansion portion is expanded in a connected state of the connecting device.

Item 53. The connecting device according to any of items 43-52, wherein the connecting device comprises a male connecting element (317) and a female connecting element (321), the male connecting element being configured to engage with the female connecting element for providing said vertical connection.

Item 54. The connecting device according to item 53, wherein the male connecting element comprises an elongated portion (332) and the female connecting element comprises a cavity (330) and, optionally, at least one protrusion (322, 323).

Item 55. The connecting device according to item 53 or 54, wherein the male connecting element is provided in the first connecting element and the female connecting element is provided in the second connecting element.

Item 56. The connecting device according to item 53 or 54, wherein the male connecting element is provided in the second connecting element and the female connecting element is provided in the first connecting element.

Item 57. The connecting device according to item 56, wherein the second connecting element comprises a first (333) and/or a second (334) tongue that are configured to be at least partly provided in a recess (140, 240) provided in an edge portion (160, 270) of the first floor panel and/or the second floor panel in the vertically connected state.

Item 58. The connecting device according to any of items 43-57, wherein the first connecting element and the second connecting element are configured to be connected to each other by snapping.

Item 59. The connecting device according to any of items 43-58, wherein the second connecting element comprises a bevel portion (328*a*).

Item 60. The connecting device according to any of items 43-59, wherein a transversal width of an upper portion (328) of the second connecting element increases towards a top surface (328*b*) of the second connecting element.

Item 61. The connecting device according to any of items 43-60, wherein a longitudinal extension of the second connecting element is larger than a longitudinal extension of the first connecting element.

Item 62. The connecting device according to any of items 43-61, wherein the second connecting element comprises a hole (301).

Item 63. The connecting device according to any of items 43-62, wherein first connecting device is configured to be connected, such as horizontally and/or vertically connected, to the first panel.

Item 64. The connecting device according to any of items 43-63, wherein a bottom portion (315) of the first connecting element comprises at least one base portion (319*a-c*).

The invention claimed is:

1. A flooring system comprising floor panels and a connecting system for connecting the floor panels, wherein the flooring system comprises:

a first floor panel and a second floor panel, and a connecting device comprising a first connecting element and a second connecting element, wherein the first connecting element is configured to cooperate with the first floor panel and the second floor panel for horizontally connecting the first floor panel and the second floor panel, the first connecting element comprising a first locking element configured to engage with a locking groove provided in an underside of the first floor panel and a second locking element configured to engage with a locking groove provided in an underside of the second floor panel, wherein the second connecting element is configured to cooperate with the first connecting element for vertically connecting the first floor panel and the second floor panel, the connecting device comprising a male connecting element and a female connecting element, the male connecting element being configured to engage with the female connecting element for providing said vertical connection, wherein an edge portion of the first floor panel or the second floor panel comprises a recess, and wherein an expansion portion of the connecting device is configured to be at least partly provided in the recess of the first or second floor panel when the first and second connecting elements are cooperating and thereby vertically connecting the first floor panel and the second floor panel, said expansion portion being further configured to expand during connection of the first and second connecting elements, wherein, when the first and second floor panels are fully engaged to each other with the connecting device, the connecting device is between the first and second floor panels and spaces the first and second floor panels from each other along an entirety of a cross-section through a vertical plane of the flooring system, and wherein the expansion portion is expanded in a connected state of the connecting device.

2. The flooring system according to claim 1, wherein the recess of the first or second floor panel is provided below an upper lip and above a lower lip provided in the edge portion.

3. The flooring system according to claim 2, wherein the lower lip extends horizontally beyond the upper lip, or wherein the lower lip has the same horizontal extension as the upper lip.

4. The flooring system according to claim 2, wherein the second connecting element is configured to be spaced from the lower lip of the first or second panel when the first and second panels are vertically connected.

5. The flooring system according to claim 2, wherein the second connecting element is configured to engage with the first or second panel, when the first and second panels are vertically connected.

6. The flooring system according to claim 2, wherein the lower lip comprises an inclined upper surface.

7. The flooring system according to claim 2, wherein the second connecting element is configured to engage with the first and the second panel, when the first and second panels are vertically connected.

8. The flooring system according to claim 2, wherein the second connecting element is configured to engage with a lower lip of the first and second panel, when the first and second panels are vertically connected.

9. The flooring system according to claim 1, wherein the female connecting element is provided in the second connecting element and comprises the expansion portion, and wherein an engagement between the male and the female connecting elements causes an expansion of the expansion portion, or wherein the expansion portion is provided as a deformable portion of the connecting device.

10. The flooring system according to claim 1, wherein the expansion portion is provided in the second connecting element, such as in a lower portion of the second connecting element.

11. The flooring system according to claim 1, wherein the expansion portion is configured to expand in a transverse direction of the connecting device.

12. The flooring system according to claim 1, wherein the connecting device and the first or second floor panels are configured such that, in a vertically disconnected state of the first or the second panel when the second connecting element is disconnected from the first connecting element, the first or the second floor panel is removable from the connecting device by a vertical displacement of the first or the second floor panel only, without any angling of the panel.

13. The flooring system according to claim 1, wherein the floor panels are configured to be floating when connected.

14. The flooring system according to claim 1, wherein the edge portion of the first floor panel and the second floor panel comprises a recess, and the expansion portion of the connecting device is configured to be at least partly provided in the recess of the first and second floor panel when the first and second connecting elements are cooperating and thereby vertically connecting the first floor panel and the second floor panel.

15. The flooring system according to claim 1, wherein the recess of the first and the second floor panel are provided below an upper lip and above a lower lip provided in the edge portion.

16. The flooring system according to claim 15, wherein the lower lip comprises an inclined upper surface.

17. The flooring system according to claim 1, wherein the connecting device and the first and the second floor panels are configured such that, in a vertically disconnected state of the first or the second panel when the second connecting element is disconnected from the first connecting element, the first and the second floor panel is removable from the connecting device by a vertical displacement of the first and the second floor panel only, without any angling of the panel.

* * * * *